US010199703B2

(12) United States Patent
Koul et al.

(10) Patent No.: US 10,199,703 B2
(45) Date of Patent: Feb. 5, 2019

(54) PHASE SHIFTER COMPRISED OF PLURAL COPLANAR WAVEGUIDES CONNECTED BY SWITCHES HAVING CANTILEVER BEAMS AND MECHANICAL SPRINGS

(71) Applicant: Synergy Microwave Corporation, Paterson, NJ (US)

(72) Inventors: Shiban K. Koul, New Delhi (IN); Ajay Kumar Poddar, Elmwood Park, NJ (US); Sukomal Dey, New Delhi (IN); Ulrich L. Rohde, Upper Saddle River, NJ (US)

(73) Assignee: Synergy Microwave Corporation, Paterson, NJ (US)

( * ) Notice: Subject to any disclaimer, the term of this patent is extended or adjusted under 35 U.S.C. 154(b) by 0 days.

(21) Appl. No.: 15/391,203

(22) Filed: Dec. 27, 2016

(65) Prior Publication Data

US 2017/0187086 A1 Jun. 29, 2017

Related U.S. Application Data

(60) Provisional application No. 62/272,285, filed on Dec. 29, 2015.

(30) Foreign Application Priority Data

Dec. 23, 2016 (EP) ..... 16206586

(51) Int. Cl.
*H01P 1/185* (2006.01)
*H01P 1/12* (2006.01)
(Continued)

(52) U.S. Cl.
CPC ..... *H01P 1/185* (2013.01); *H01H 59/0009* (2013.01); *H01P 1/12* (2013.01);
(Continued)

(58) Field of Classification Search
CPC .. H01P 1/185; H01P 1/184; H01P 1/18; H01P 9/00; H01P 1/10; H01P 1/12; H01P 1/127
(Continued)

(56) References Cited

U.S. PATENT DOCUMENTS 3,454,906 A 7/1969 Hyltin et al.
3,872,409 A 3/1975 Hatkin
(Continued)

FOREIGN PATENT DOCUMENTS

CN 101090169 A 12/2007
CN 105742124 A 7/2016
EP 2493014 A2 8/2012

OTHER PUBLICATIONS

Al Qun Liu et al, RF MEMS Switches and Integrated Switchin Circuits, Springer Science+Business Media, LLC (2010), pp. 115-132.

(Continued)

*Primary Examiner* — Benny Lee
(74) *Attorney, Agent, or Firm* — Lerner, David, Littenberg, Krumholz & Mentlik, LLP

(57) ABSTRACT

The present disclosure provides for a phase shifter having at least one phase shift section. The phase shift section includes an input port for receiving an incoming radio frequency signal, an output port for transmitting an outgoing radio frequency signal, an input junction coupled to the input port, an output junction coupled to the output port, and a plurality of transmission lines. The input junction includes a first plurality of cantilever type switches, and the output junction includes a second plurality of cantilever type switches. Each transmission line connects one of the first plurality of cantilever type switches to a corresponding one of the second plurality of cantilever type switches. The first plurality of cantilever type switches, the second plurality of
(Continued)

cantilever type switches, and the plurality of transmission lines are formed in a coplanar waveguide.

22 Claims, 13 Drawing Sheets

(51) Int. Cl.
*H01H 59/00* (2006.01)
*H01P 1/18* (2006.01)

(52) U.S. Cl.
CPC ..... *H01P 1/127* (2013.01); *H01P 1/182* (2013.01); *H01P 1/184* (2013.01)

(58) Field of Classification Search
USPC ..... 333/161, 164
See application file for complete search history.

(56) References Cited

U.S. PATENT DOCUMENTS 4,672,257 A 6/1987 Oota et al.
4,806,888 A 2/1989 Salvage et al.
4,931,753 A * 6/1990 Nelson et al. ..... H01L 27/0605 257/E27.012
4,977,382 A 12/1990 Podell et al.
5,093,636 A 3/1992 Higgins, Jr. et al.
5,168,250 A 12/1992 Bingham
5,355,103 A 10/1994 Kozak
5,463,355 A 10/1995 Halloran
5,619,061 A 4/1997 Goldsmith et al.
6,046,659 A 4/2000 Loo et al.
6,133,807 A * 10/2000 Akiyama et al. ..... H01P 1/12 200/181
6,153,839 A 11/2000 Zavracky et al.
6,281,838 B1 * 8/2001 Hong ..... H01Q 3/36 333/139
6,307,452 B1 10/2001 Sun
6,356,166 B1 3/2002 Goldsmith et al.
6,509,812 B2 1/2003 Sayyah
6,531,935 B1 3/2003 Russat et al.
6,542,051 B1 4/2003 Nakada
6,621,390 B2 9/2003 Song et al.
6,657,324 B1 12/2003 Marumoto
6,741,207 B1 * 5/2004 Allison et al. ..... H01P 1/184 333/164
6,806,789 B2 10/2004 Bawell et al.
6,812,814 B2 11/2004 Ma et al.
6,849,924 B2 2/2005 Allison et al.
6,853,691 B1 2/2005 Kim
6,949,985 B2 9/2005 Qiu et al.
6,958,665 B2 10/2005 Allison et al.
7,053,736 B2 5/2006 Nelson
7,068,220 B2 6/2006 DeNatale et al.
7,157,993 B2 1/2007 DeNatale et al.
7,242,273 B2 * 7/2007 Isobe et al. ..... H01H 59/0009 200/181
7,259,641 B1 8/2007 Weller et al.
7,570,133 B1 * 8/2009 Taft et al. ..... H01P 1/184 333/156
7,835,157 B2 11/2010 Tilmans et al.
8,451,078 B2 5/2013 Lai et al.
8,581,679 B2 11/2013 Min et al.
2002/0186108 A1 * 12/2002 Hallbjorner ..... H01P 1/12 335/78
2003/0102936 A1 6/2003 Schaefer
2004/0061579 A1 4/2004 Nelson
2005/0099252 A1 5/2005 Isobe et al.
2006/0109066 A1 5/2006 Borysenko
2008/0272857 A1 11/2008 Singh
2009/0074109 A1 3/2009 Foo
2012/0194296 A1 8/2012 Unlu et al.
2017/0187086 A1 6/2017 Koul et al.

OTHER PUBLICATIONS

Ashtiani et al., "Direct Multilevel Carrier Modulation Using Millimeter-Wave Balanced Vector Modulators," IEEE Transactions on Microwave Theory and Techniques, vol. 46, No. 12, Dec. 1998, pp. 2611-2619.
Barker et al., "Distributed MEMS True-Time Delay Phase Shifters and Wide-Band Switches," IEEE Transactions on Microwave Theory and Techniques, vol. 46, No. 11, Nov. 19998, pp. 1881-1890.
Barker et al., "Optimization of Distributed MEMS Transmission-Line Phase Shifters—U-Band and W-Band Designs," IEEE Transaction on Microwave Theory and Techniques, vol. 48, No. 11, Nov. 2000, pp. 1957-1966.
Chang et al., "A Tunable Broadband Photonic RF Phase Shifter Based on a Silicon Microring Resonator," IEEE Photonics Technology Letters, vol. 21, No. 1, pp. 60-62, Jan. 1, 2009.
Cho et al., "Design and fabrication of a single membrane push-pull SPDT RF MEMS switch operated by electromagnetic actuation and electrostatic hold," Journal of Micromechanics and Microengineering, vol. 20, pp. 1-7 (plus 1 page), 2010.
Choi et al., "A 5-20 GHz 5-Bit True Time Delay Circuit in 0.18 mm CMOS Technology," Journal of Semiconductor Technology and Science, vol. 13, No. 3, pp. 193-197, Jun. 2013.
De Los Santos et al., "Microwave and Mechanical Considerations in the Design of MEM Switches for Aerospace Applications," Proc. IEEE Aerospace Conf., vol. 3, pp. 235-254, 1997.
Devlin et al., "A Versatile Vector Modulator Design for MMIC," IEEE International Microwave Symposium Digest, Dallas, TX, USA, pp. 519-522, May 1990.
Dey Sukomal et al., "Reliability Analysis of Ku-Band 5-bit Phase Shifters Using MEMS SP4T and SPDT Switches", IEEE Transactions on Microwave Theory and Techniques, Dec. 2015, pp. 3997-4012, vol. 63, No. 12, IEEE Service Center, Piscataway, NJ, US.
Du Y et al., "A X-band switched-line 5-bit phase shifter with RF MEMS multithrow switches", Nano/Micro Engineered and Molecular Systems (NEMS), Apr. 2013, pp. 296-299, 2013 8th IEEE International Conference on IEEE.
Erker et al., "Monolithic Ka-Band Phase Shifter Using Voltage Tunable BaSrTiO3 Parallel Plate Capacitors," IEEE Microwave and Guided Wave Letters, vol. 10, No. 1, pp. 10-12, Jan. 2000.
European Search Report for Application No. EP16206586 dated May 12, 2017.
Extended European Search Report for Appln. No. EP16206593.2 dated May 30, 2017.
G.M. Rebeiz et al., RF MEMS—Theory, Design, and Technology, John Wiley & Sons, Inc., Hoboken, NJ, (2003) pp. 259-291 and 297-323.
Goldsmith et al., "Characteristics of Micromachined Switches At Microwave Frequencies," IEEE MTT-S Int. Microwave Symposium Digest, pp. 1141-1144, 1996.
Gong et al., "A 60-GHz 2-bit Switched-Line Phase Shifter Using SP4T RF-MEMS Switches," IEEE Transactions on Microwave Theory and Techniques, vol. 59, No. 4, pp. 894-900 Apr. 2011.
Guan-Leng Tan et al., "Low-Loss 2- and 4-bit TTD MEMS Phase Shifters Based on SP4T Switches", IEEE Transactions on Microwave Theory and Techniques, Jan. 2003, pp. 297-304, vol. 1, No. 51, IEEE Service Center, Piscataway, NJ, US.
Hacker et al., "A Ka-Band 3-Bit RF MEMS True-Time-Delay Network," IEEE Transactions on Microwave Theory and Techniques, vol. 51, No. 1, pp. 305-308, Jan. 2003.
Hayden et al., "Very Low-Loss Distributed X-Band and Ka-Band MEMS Phase Shifters Using Metal-Air-Metal Capacitors," IEEE Transactions on Microwave Theory and Techniques, vol. 51, No. 1, pp. 309-314, Jan. 2003.
Hord Jr. et al., "A New Type of Fast Switching Dual-Mode Ferrite Phase Shifter," IEEE Trans. Microwave Theory Tech., vol. 35, No. 12, pp. 985-988, Dec. 1987.
Hung et al., "Distributed 2- and 3-Bit-Band MEMS Phase Shifters on Glass Substrates," IEEE Transactions on Microwae Theory and Techniques, vol. 52, No. 2, pp. 600-606, Feb. 2004.

(56) References Cited

OTHER PUBLICATIONS

Hyman et al., "Surface-Micromachined RF MEMs Switches on GaAs Substrates," Int. J. RF Micrwave CAE, vol. 9, No. 4, pp. 348-361, 1999.
Jacomb-Hood et al., "A Three-Bit Monolithic Phase Shifter At V-Band," IEEE Microwave and Millimeter-Wave Monolithic Circuits Symposium Digest, pp. 81-84, Jun. 1987.
Kang et al., "Ku-Band MMIC Phase Shifter Using a Parallel Resonator With 0.18-m CMOS Technology," IEEE Transactions on Microwave Theory and Techniques, vol. 54, No. 1, pp. 294-301, Jan. 2006.
Kim et al., "Linear Tunable Phase Shifter Using a Left-Handed Transmission Line," IEEE Microwave and Wireless Components Letters, vol. 15, No. 5, pp. 366-368, May 2005.
Koh et al., "0.13-mm CMOS Phase Shifters for X-, Ku-, and K-Band Phased Arrays," IEEE Journal of Solid-State Circuits, vol. 42, No. 11, pp. 2535-2546 (plus 2 pages), Nov. 2007.
Koh et al., "A 6-18 GHz 5-Bit Active Phase Shifter," IEEE MTT-S Int. Microw. Symp. Dig., Montreal, Anaheim, CA, pp. 792-795, May 2010.
Larson et al., "Microactuators for GaAs-Based Microwave Integrated Circuits," Transducers '91 Int. Conf., pp. 743-746, 1991.
Liu A. et al., "Single-Pole-Four-Throw Switch Using High-Aspect-Ratio Lateral Switches", Electronics Letters, IEE Stevenage, GB, vol. 40, No. 18, Sep. 2, 2004, pp. 1125-1126, XP006022539, ISSN: 0013-5194, DOI: 10.1049/EL: 20045718.
Majumder et al., "Measurement and Modeling of Surface Micromachined, Electrostatically Actuated Microswitches," Tech. Digest, 1997 Int. Conf. on Solid-State Sensors and Actuators, pp. 1145-1148, Jun. 1997.
Malczewski et al., "X-Band RF MEMS Phase Shifters for Phased Array Applications," IEEE Microwave and Guided Wave Letters, vol. 9, No. 12, pp. 517-519, Dec. 1999.
Min et al., "Single-Ended and Differential Ka-Band BiCMOS Phased Array Front-Ends," IEEE Journal of Solid-State Circuits, vol. 43, No. 10, pp. 2239-2250, Oct. 2008.
Müller et al., "Tunable Passive Phase Shifter for Microwave Applications Using Highly Anisotropic Liquid Crystals," IEEE MTT-S Int. Microw. Symp. Dig., Fort Worth, TX, USA, pp. 1153-1156, Jun. 2004.
Norris et al., "A Fully Monolithic 4-18 GHZ Digital Vector Modulator," IEEE International Microwave Symposium Digest, Dallas, TZ, USA, pp. 789-792, May 1990.
Pacheco et al., "MEMS Single-Pole Double-Throw (SPDT) X and K-Band Switching Circuits," IEEE MTT-S Int. Microwave Symposium Digest, vol. 1, pp. 321-324, 2001.
Park et al., "A 35-60 GHz Single-Pole Double-Throw (SPDT) Switching Circuit Using Direct Contact MEMS Swithces and Double Resonance Technique," 12th Int. Conf. Transducers, Solid-State Sensors, Actuators and Microsystems, vol. 2, pp. 1796-1799, Jun. 2003.
Park et al., "Electroplated RF MEMS Capacitive Switches," 13th Annual Int. Conf. on Micro Electro Mechanical Systems, pp. 639-644, 2000.
Pillans et al., "Advances in RF MEMS Phase Shifters from 15 GHz to 35 GHz," IEEE MTTT-S Int. Microw. Symp. Dig., Montreal, QC, Canada, pp. 1-3, Jun. 2012.
Pyndiah et al., "GaAs Monolithic Direct Linear (1-2.8) GHz Q.P. S.K. Modulator," 19th European Microwave Conf. Dig., London, UK, pp. 597-602, Sep. 1989.
Rebeiz et al., "RF MEMS Switches and Switch Circuits," Microwave Magazine, University of Michigan, Ann Arbor, USA, pp. 59-71, Dec. 2001.
Robert V. Garver, "Broad-Band Diode Phase Shifters," IEEE Transactions on Microwave Theory and Techniques, vol. MTT-20, No. 5, pp. 314-323, May 1972.
Scardelletti et al., "MEMS, Ka-Band Single-Pole Double-Throw (SPDT) Switch for Switched Line Phase Shifters," IEEE Antennas & Propagation Society Int. Symp., vol. 2, pp. 2-5, Jun. 2002.
Schauwecker et al., "Single-Pole-Double-Throw Switch Based on Toggle Switch," Electronic Letters, vol. 39, No. 3, pp. 668-670, Apr. 2003.
Schindler et al., "A 3 Bit K/Ka Band MMIC Phase Shifter," IEEE Microwave and Millimeter-Wave Monolithic Circuits Symposium Digest, New York, NY, USA, pp. 95-98, 1988.
Shen et al., "Low Actuation Voltage RF MEMS Switches With Signal Frequencies From 025GHz to 40GHz," Proc. Int. Electron Devices Meeting, pp. 689-692, 1999.
Tan et al., "Low-Loss 2- and 4-bit TTD MEMS Phase Shifters Based on SP4T Switches," IEEE Transactions on Microwave Theory and Techniques, vol. 51, No. 1, pp. 297-304, Jan. 2003.
Tang M. et al, "A Low-Loss Single-Pole-Double-Throw (SPDT) Switch Circuit", Solid-State Sensors, Actuators and Microsystems Conference, 2007. Transducers 2007. International, IEEE, Piscataway, NJ, USA, Jun. 10, 2007, pp. 679-682, XP031216121, ISBN: 978-1-4244-0841-2.
Telliez, et al., "A Compact, Monolithic Microwave Demodulator-Modulator for 64-QAM Digital Radio Links," IEEE Transactions on Microwave Theory and Techniques, vol. 39, No. 12, pp. 1947-1954, Dec. 1991.
Unlu et al., "A 15-40-GHz Frequency Reconfigurable RF MEMS Phase Shifter," IEEE Transactions on Microwave Theory and Techniques, vol. 61, No. 8, pp. 2865-2877, Aug. 2013.
Vähä-Heikkilä, et al., "RF MEMS Impedance Tuners for 6-4 GHz Applications," Int. J. RF Microw. Comput.-Aided Eng., vol. 17, No. 3, pp. 265-278, May 2007.
Yamane et al., "A Ku-band Dual-SPDT RF-MEMS Switch by Double-Side SOI Bulk Micromachining," Journal of Microelectromechanical Systems, vol. 20, No. 5, pp. 1211-1221 , Oct. 2011.
Yao et al., "Micromachined Low-Loss Microwave Switches," IEEE Journal of Microelectromechanical Systems, vol. 8, No. 2, pp. 129-134, Jun. 1999.
Schlieter DB, Henderson RM. Silicon integrated defected ground structures. InSilicon Monolithic Integrated Circuits in RF Systems (SiRF), 2010 Topical Meeting on Jan. 11, 2010 (pp. 92-95). IEEE.
Partial Search Report including Written Opinion for European Patent Application No. 18160897.7 dated Jul. 18, 2018.
European Search Report for Application No. EP18189450 dated Nov. 7, 2018, 4 pages.

* cited by examiner

PHASE SHIFTER COMPRISED OF PLURAL COPLANAR WAVEGUIDES CONNECTED BY SWITCHES HAVING CANTILEVER BEAMS AND MECHANICAL SPRINGS

CROSS-REFERENCE TO RELATED APPLICATIONS

The present application claims the benefit of the filing date of U.S. Provisional Patent Application No. 62/272,285 filed Dec. 29, 2015, and European Application No. 16206586.6, filed Dec. 23, 2016, the disclosures of which are hereby incorporated herein by reference.

FIELD OF THE TECHNOLOGY

The present disclosure relates to devices and techniques for introducing phase shifts in RF applications such as for example, in electronically scanned phase array antennas, and more particularly to phase shifting devices and techniques using micro electromechanical system (MEMS) based switches.

BACKGROUND

Microwave phase shifters are a critical component of a transmit/receive (T/R) module in passive electronically scanned arrays (ESAs), and are used widely in commercial and other applications. Utilizing low loss phase shifters in a T/R module lowers the power requirements, and hence lowers the number of components required. This may in turn lead to smaller size and lower costs. The T/R module operating at Ku-band frequencies (e.g., between about 12 GHz and about 18 GHz) may enable the use of ESAs and ESA antennae for wide-swath, high-resolution synthetic aperture radar (SAR), imaging of terrestrial snow covers, etc. For a T/R module having four transmit channels and eight receiver channels, a 5-bit phase shifter to handle 32 signals separated by their respective phases is a useful component.

Different types of digital phase shifters have been implemented in the past using Monolithic Microwave Integrated Circuit (MMIC) and Complementary Metal-Oxide Semiconductor (CMOS) technologies. MMIC based phase shifts are often large in size, exhibit large loss, and may be subject to low yield. CMOS based phase shifters are often compact in size, but in order to compensate for the loss and noise, such phase shifters (which are active phase shifters) require a T/R module at each antenna element. This greatly increases the cost of the CMOS based phased arrays. By comparison, phased arrays for which one T/R module may be connected to multiple low-loss phase shifters affords a lower component count, and are thus is less expensive.

A phased array may be implemented using any of ferrite-based phase shifters, semiconductor-based (PIN diode or transistor) phase shifters, and MEMS-based phase shifters. Phase shifters may be implemented using several different topologies, such as switched-line, distributed MEMS transmission line (DMTL), quasi lumped element or reflect line configurations. Generally, these topologies permit for design of phase shifters up to 6-bits. Phase shifters are also capable of achieving frequency reconfiguration using liquid-crystal, photonic and/or ferroelectric technologies. Phase shifters designed using the above technologies are capable of performing a specific task over a single band of interest.

MEMS-based technology, in particular, has the ability to achieve low loss, improved matching, low direct current (DC) power consumption, and improved phase accuracy of the transmitted signals over a frequency band of interest, as compared to other contemporary solid state technologies such as PIN diodes and transistor-based switches (e.g., FET switches), while maintaining a relatively compact size. The MEMS-based phase shifters may be designed as either analog or digital. Analog phase shifters, as the name refers, may be used for controlling the insertion phase within 0-360° by means of varactors. Digital phase shifters may be used for producing discrete phase delays, which may be selected by means of switches (switched line, loaded line phase shifter) or varactors (a DMTL phase shifter). Therefore, to fulfill demand for modern RF systems and for high-precision instrumentation, it is desirable to implement a phased array using MEMS-based digital phase shifters.

However, with each of the above referenced technologies (including MEMS) for implementing phase shifters in an RF phased array, it is challenging to achieve low loss with acceptable phase shift and with acceptable repeatability within a small area. These challenges become even greater with higher bit-configurations, and with lower microwave frequency, such as frequencies below 20 GHz.

DMTL is one choice that yields relatively good insertion loss performance. However, operation of DTML becomes nonlinear with variation of phase delay over the operating frequency band once it crosses the Bragg frequency, which occurs when a unit cell of the DMTL is one third of the wavelength of the operating frequency. Moreover, area (along the length) of the DMTL phase shifter necessarily becomes large with higher-bit (e.g., 3-bit or greater) configurations at lower frequency (e.g., 20 GHz or lower).

Furthermore, in a conventional switched line 5-bit phase shifter, a minimum of 10 switches must be activated at any given time in order to achieve the desired phase shift. Stated differently, each section of the conventional switched line phase shifter controls a single bit based on the state of two switches (one switch on either side of the 1-bit section). However, it is desirable that fewer switches be activated at a given time, in order to reduce power consumption of the phase shifter.

SUMMARY OF THE INVENTION

The present disclosure provides for a 5-bit phase shifter that achieves low loss, low power consumption, and good phase accuracy within a compact size, even for radio frequency signals within the Ku band of the radio frequency spectrum. The 5-bit phase shifter utilizes a combination of MEMS-based single pole multiple throw (SPMT) switches formed in a coplanar waveguide. In other words, the transmission lines over which the radio frequency signal is transmitted are formed on the same side of a substrate as the ground electrode or layer, and the transmission lines are connected to one another within the same plane as the lines and ground using MEMS-based SPMT switches.

One aspect of the present disclosure provides for a phase shifter including at least one phase shift section. The phase shift section includes an input port for receiving an incoming radio frequency signal, an output port for transmitting an outgoing radio frequency signal, an input junction coupled to the input port, an output junction coupled to the output port, and a plurality of transmission lines. The input junction includes a first plurality of switches, and the output junction includes a second plurality of switches. Each of the plurality of transmission lines connects one of the first plurality of switches to a corresponding one of the second plurality of switches. The first plurality of switches, the second plurality of switches, and the plurality of transmission lines are formed in a coplanar waveguide.

In some examples, the input junction may include at least four cantilever type switches, and the output junction may include at least four cantilever type switches. In other examples, the input junction may include at least eight cantilever type switches, and the output junction may include at least eight cantilever type switches. In yet further examples, the input junction may include sixteen cantilever type switches, and the output junction may include sixteen cantilever type switches.

The phase shifter may further include at least two phase shift sections, such that an output junction one phase shift section is coupled to an input junction of the other phase shift section by a transmission line formed in the coplanar waveguide. The transmission line connecting the phase shift sections may include an inductive section for matching inductances of the phase shift sections. For at least two of these phase shift sections, the input junction of each phase shift section may include at least four cantilever type switches, and the output junction of each phase shift section may include at least four cantilever type switches. A third phase shift section may have an input junction including at least two cantilever type switches, and an output junction including at least two cantilever type switches.

Another aspect of the disclosure provides for a phase shifter, including a first 2-bit section with first and second single pole four throw (SP4T) microelectromechanical switch circuits formed on a substrate on a same side as ground potential (e.g., a CPW), a second 2-bit phase shift section including third and fourth SP4T microelectromechanical switch circuits formed on a substrate on a same side as ground potential, and a third 1-bit phase shift section including first and second single pole double throw (SPDT) microelectromechanical switch circuits formed on a substrate on a same side as ground potential. Each of switches in the SP4T and SPDT microelectromechanical switch circuits may be a single-contact switch about 2 microns thick. Only six switches of the phase shifter need to be actuated at a given time to produce a 5-bit output. In some examples, the phase shifter may occupy an area of about 5.17 mm by about 3.19 mm. In other examples, the phase shifter may occupy an area of about 4.7 mm by about 2.8 mm.

The phase shifter may include a 2-bit section including first and second single pole four throw (SP4T) microelectromechanical switch circuits, and a 3-bit phase shift section including first and second single pole eight throw (SP8T) microelectromechanical switch circuits. In such an example, only four switches of the phase shifter need to be actuated at a given time to produce a 5-bit output.

Alternatively, the phase shifter may include a substrate, first and second single pole sixteen throw (SP16T) microelectromechanical switch circuits, and sixteen signal lines, each signal line connecting respective switches of the first and second SP16T switch circuits to one another. Only two switches of the phase shifter may need to be actuated at a given time to produce a 4-bit output. This phase shifter may exhibit uniform switch actuation, may occupy an area of about 15.2 $mm^2$ on a surface of the substrate, or both.

In any of the above examples, the sections of the phase shifter may be cascaded (e.g., in series) on a coplanar waveguide line. The phase shifter may produce a 5-bit output with fewer than ten switches actuated at a given time. The phase shifter may operable in the Ku frequency band with a bandwidth of about 500 MHz.

Yet a further aspect of the present disclosure provides for a phase array including a plurality of phase shifters as described herein. The phase array may be a passive electronically scanned array and may include a plurality of radiating elements. Each radiating element may include a corresponding one of the plurality of phase shifters of the phase array.

DETAILED DESCRIPTION OF THE INVENTION

Figure 1:
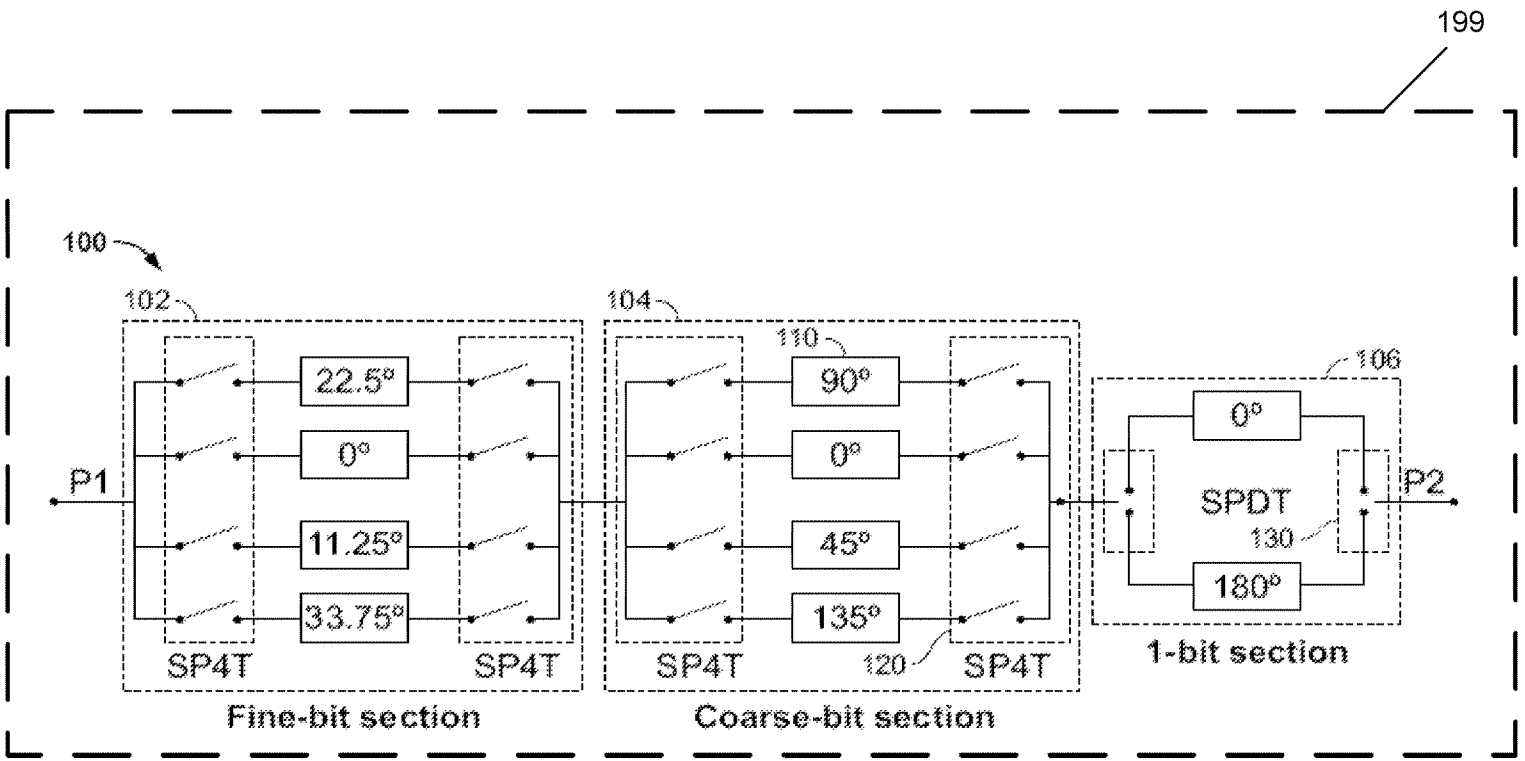
FIG. 1 is a schematic diagram illustrating an example phase shifter in accordance with the present disclosure.

FIG. 1 is a schematic diagram example of a radio frequency phase shifter 100 in accordance with an aspect of the disclosure. The phase shifter may be included in a phase array 199. The phase shifter 100 includes an input port P1, an output port P2, and three cascaded sections: a fine 2-bit section 102; a coarse 2-bit section 104 and a 1-bit section 106. Each section includes a pair of single-pole multi-throw (SPMT) switches, one switch at the input side of the section, and a corresponding switch at the output side. Each switch has a plurality of switchable elements, which are also commonly referred to as "switches." For purposes of clarity, the present disclosure refers to the SPMT switches as "switch circuits" and the switchable elements contained therein as "switches."

For each single-pole multi-throw switch circuit, only one switch of the circuit is activated at a given time. For every pair of switch circuits in the phase shifter 100, each switch of one switch circuit has a one-to-one correspondence to a switch of the other switch circuit, such that when the switch of the first switch circuit is activated, the corresponding switch of the other switch circuit is activated, and the remaining switches remain inactive.

Each corresponding pairs of switches are connected to one another via a respective channel 110, such that a radio frequency signal received at the switch at the circuit on the input side of the section may be transmitted through the channel 110 to the corresponding switch of the circuit on the output side of the section. Both the fine 2-bit section 102 and the coarse 2-bit section 104 include a pair of single-pole four-throw switch circuits 120 connected by four channels. The 1-bit section 106 includes a pair of single-pole double throw switch circuits 130 connected by two channels.

Each channel 110 may be a signal line (e.g., transmission line) formed in a coplanar waveguide (CPW), meaning that the transmission lines are in plane (e.g., on the same side of the substrate on which the lines are formed) as the ground electrode of the device. This stands in contrast to other higher-bit phase shifters (e.g., 4-bit, 5-bit, etc) that are configured in a microstrip line. The microstrip line configuration increases production difficulties and further requires the formation of vias for grounding and radial stubs for matching. The CPW configuration of the present disclosure avoids these complications and requirements by designing the ground lines to follow closely with the respective signal lines.

As a radio frequency signal is transmitted over a signal line between corresponding switches (from the input-side switch circuit to the output-side switch circuit) it may undergo a phase shift, depending on the configurations and characteristics of the channel. In the present disclosure, each channel of a given phase shifter section 102, 104, 106 is designed to result in a different respective phase shift. Specifically, in the example of FIG. 1, the channels 110 of the 1-bit section 106 provide a 0 or 180 degree phase shift, respectively. Thus, the signal is shifted 180 degrees, or not shifted at all, depending on which corresponding pair of switches is activated. The channels 110 of the coarse 2-bit section 104 provide an additional 0, 45, 90, or 135 degree phase shift, respectively, again depending on which corresponding pair of switches is activated. The channels 110 of the fine 2-bit section 102 provide an additional 0, 11.25, 22.5 or 33.75 degree phase shift, again depending on which corresponding pair of switches is activated. For example, if it is desired to apply a 292.5 degree phase shift to a signal, each of the 22.5 degree phase shift channel of the fine 2-bit section 102, the 90 degree phase shift channel of the coarse 2-bit section 104 and the 180 degree phase shift channel of the 1-bit section 106 would be opened by activating the switches on either side of those respective channels, while leaving the remaining switches of the phase shifter inactive.

The phase shifter sections 102, 104 and 106 are serially connected to one another, such that the output of one section is the input of the next section. In the example of FIG. 1, the output of the fine 2-bit section 102 is the input for the coarse 2-bit section 104, and the output of the coarse 2-bit section 104 is the input for the 1-bit section. However, those skilled in the art should recognize that the phase shifter is capable of producing a phase array with a 5-bit output regardless of the order of the sections.

The channel configurations are also selected such that the 5-bit phased array is capable of transmitting the signal from the receive channel at any one of 32 different phases. Furthermore, the channel phase delays are selected so that the 32 different phases are evenly spread over time, in 11.25 degree increments.

Each of the two-bit sections includes a pair of single pole four throw (SP4T) switch circuits 120. These switch circuits may be MEMS-based digital switches, such as those described in the commonly owned and concurrently filed application Ser. No. 15/391,289 (the '289 application), the disclosure of which is hereby incorporated in its entirety herein. As described there, each switch may be a lateral switch having a cantilever beam with a mechanical spring connected to the midpoint of the cantilever beam, such that the mechanical spring provides a mechanical force to move the cantilever beam in a lateral direction. Alternatively, the cantilever beam may move in an out-of plane direction (relative to the plane of the waveguide), with the mechanical spring providing a mechanical force to move the cantilever beam in the out-of plane direction. In either design, each mechanical spring may be actuated by a separate actuator.

The 1-bit section 106 of the phase shifter includes a pair of single pole double throw (SPDT) switch circuits 130. Similar to the four transmission lines or channels running between the SP4T switch circuits of the 2-bit sections, the SPDT switch circuits may be MEMS-based digital switches. The switch circuits may be connected to each other by two transmission lines running between a corresponding pair of switches, and may be connected to those transmission lines using similarly designed MEMS-based switch circuits.

Taking the phase shifter of FIG. 1 as a whole, each of the 2-bit sections 102, 104 of the phase shifter 100 includes eight switches, and the 1-bit section includes four switches. In total, the phase shifter includes twenty switches. At any given time, two switches of each section (one switch per switch circuit) may be active (e.g., closed), thereby carrying the signal across a selected channel between the two activated (e.g., closed) switches. Thus, in order to carry the signal across the three sections of the phase shifter, at any given time only six switches (or two switches per cascaded stage) need to be active in order to provide a 5-bit output.

Overall, the SPDT and SP4T switch circuits of the above design are less sensitive to stress (e.g., repeated on/off changes over extended time) due to their relatively small size and relatively fast switching and release times (about 28 μsec for switching, about 21 μsec for release).

With regard to the SPDT switch circuits of the 1-bit section 106, the '289 application describes an SPDT switch circuit that includes a single, laterally-deflecting, cantilever beam capable of contacting either one of two ports on opposing sides of a free end of the beam, depending on the direction in which the beam deflects. Such an SPDT switch circuit may be designed with a single switch, or stated differently, a single deflecting element that is capable of contacting the input end of the switch to either one of two channels.

Nonetheless, in the case of MEMS-based cantilever type in-line switches, it has been found that using a single-contact cantilever switch is generally less sensitive to planarity and stress than using a multi-contact cantilever switch. A multi-contact cantilever switch may be prone to both single contact failure (e.g., one contact becoming permanently stuck in a "down" position) and actuator failure (e.g., one contact becoming permanently stuck in an "up" position). Failure of even a single switch of the phase shifter (as well as other devices relying on similar switching techniques) can significantly damage overall performance of the phase shifter. Moreover, multi-contact and other complex designs of cantilever type switches may be sensitive to stress gradient, due to an uneven distribution of tip deflection between or among the surrounding structures. For this reason, multiple voltages are often needed to actuate the switches in the desired manner. However, providing multiple voltages may decrease the overall yield of the device, especially in the case of a device in which multiple (e.g., six) switches are being actuated at a given same. By contrast, the single-contact cantilever switch improves the overall contact force of the switch, and helps to evenly distribute the electrostatic force caused by the switching over the various paths in phase shifter.

Figure 2:
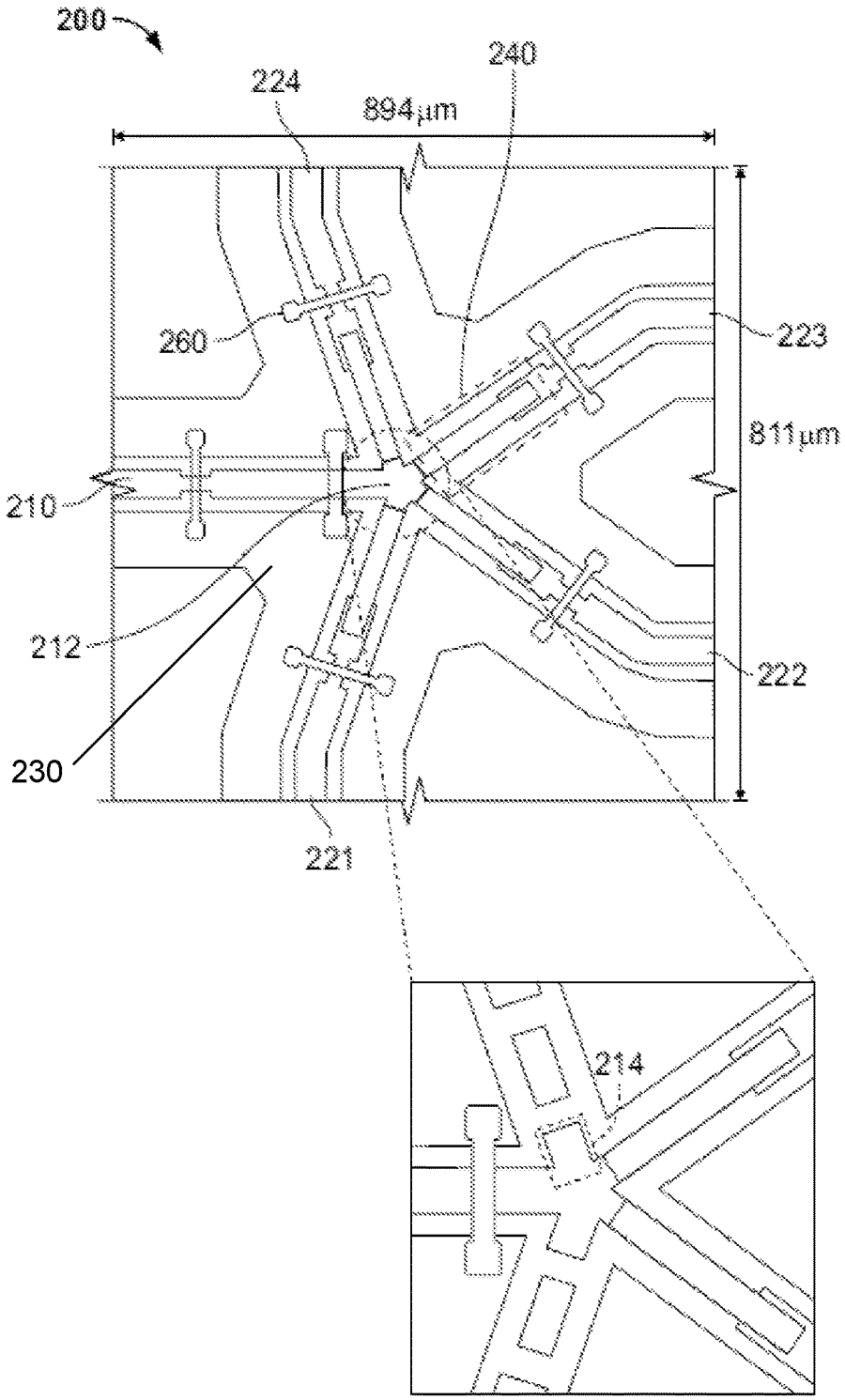
FIG. 2 is a schematic plan view diagram showing an example single-pole four-throw (SP4T) switch in accordance with the present disclosure.

FIG. 2 is a schematic representation of an SP4T switch circuit 200 (such as the SP4T switch circuit 120 of FIG. 1) formed in a coplanar waveguide. The portion of the coplanar waveguide shown in FIG. 2 is about 894 μm in length by about 811 μm in width. The switch circuit 200 includes an input port 210 which is a transmission line at which an RF input is provided, and a central junction 212, which is the point of the transmission line at which the RF input is bridged with each of the 2-bit section's channels 221, 222, 223, 224. The central junction 212 is connected to four cantilever type in-line switches 240 in a circular configuration. Each cantilever switch is connected to a power source (not shown). When the beam of the cantilever switch is actuated (e.g., by a bias voltage), the switch closes and the RF input travels through the respective connected transmission line or channel 221, 222, 223, 224. Each of the input and output transmission lines is formed in a channel within the plane of the ground layer 230.

The single-contact switch itself may be only about 2 microns thick, and may be packaged using a thin-film package. Placement of the single-contact switch (or otherwise referred to as a "simple" cantilever beam) on a coplanar waveguide may further improve the compactness of the overall design of the SPDT and SP4T structure.

Another factor that affects performance of the SP4T switch circuit in particular is the spoke length 214 (shown in exploded view at bottom right corner of FIG. 2) of the respective spoke extending from the central junction. The spoke length may be optimized to improve overall performance of the switch through the use of a full wave simulation.

FIG. 2 also shows each waveguide channel in the coplanar waveguide including one or more air bridges 260, bridge the respective sidewalls of the coplanar waveguide. In particular, in the example of FIG. 2, the air bridges 260 are aligned above discontinuities (e.g., tapered edges) in the input and output transmission lines. The air bridges reduce the effective permittivity of the transmission lines to extend the operating frequency of the switch. The air bridges also bridge the parts of the waveguide ground layer 230 to one another, thereby equalizing the ground potential across the entire device. Bringing the ground layer also helps to overcome higher order modes that are generated at discontinuities of the waveguide. In the present disclosure, the width of each signal line is the same, and the width of the air bridges are also the same. However, in other phase shifter designs, either or both of these properties may be varied from channel to channel in order to ensure proper performance of the phase shifter.

As explained above, for each of the 2-bit and 1-bit sections, the properties of each transmission line is designed differently, such that a signal propagating from the central junction of one switch to the central junction of the opposite switch will have a different phase delay depending on the channel. For example, in the case of the 1-bit section, the transmission lines may be designed to produce a 180 degree phase shift between their respective outputs. These varying properties of the transmission lines may include the channel length, the particular bends of the channel, geometry of the lines, etc.

Figure 3:
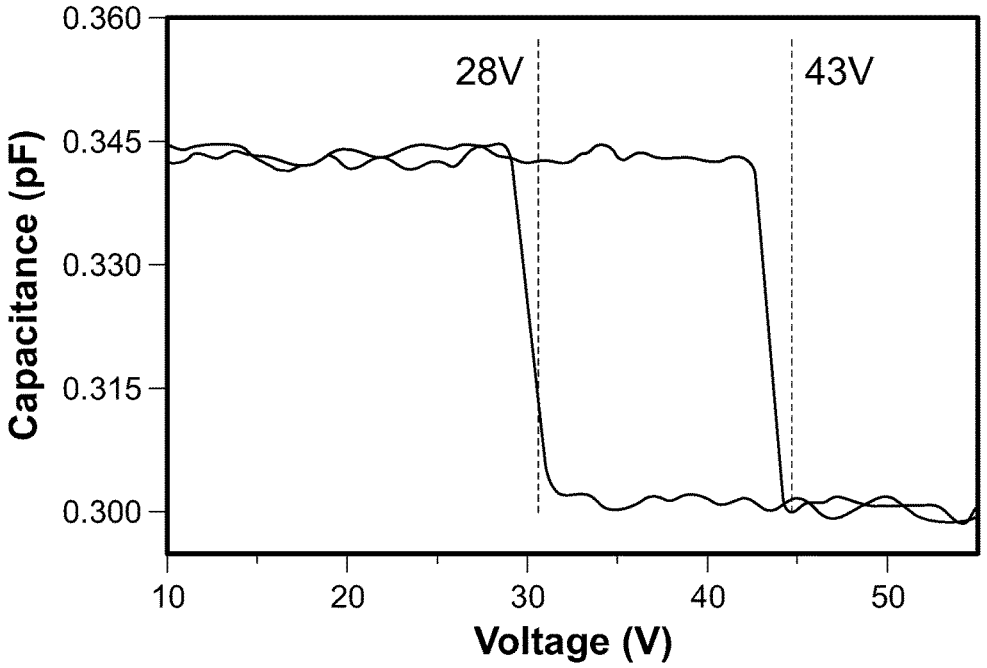
FIG. 3 is a graphical representation of pull-in and release voltages for the switch of FIG. 2.

FIG. 3 shows pull-in and release voltages (measured in volts (V)) of an example MEMS-based switch circuits (also referred to herein as a "DC-contact switch") in an SP4T configuration used to connect the central junctions to their respective transmission lines in one of the 2-bit sections of a phase shifter. As shown in FIG. 3, the switches are designed to pull-in (raising the effective capacitance of the switch from about 0.3 pF to about 0.345 pF) at about 43 V and to release (lowering the effective capacitance of the switch from about 0.345 pF back to about 0.3 pF) at about 28 V.

Figure 4:
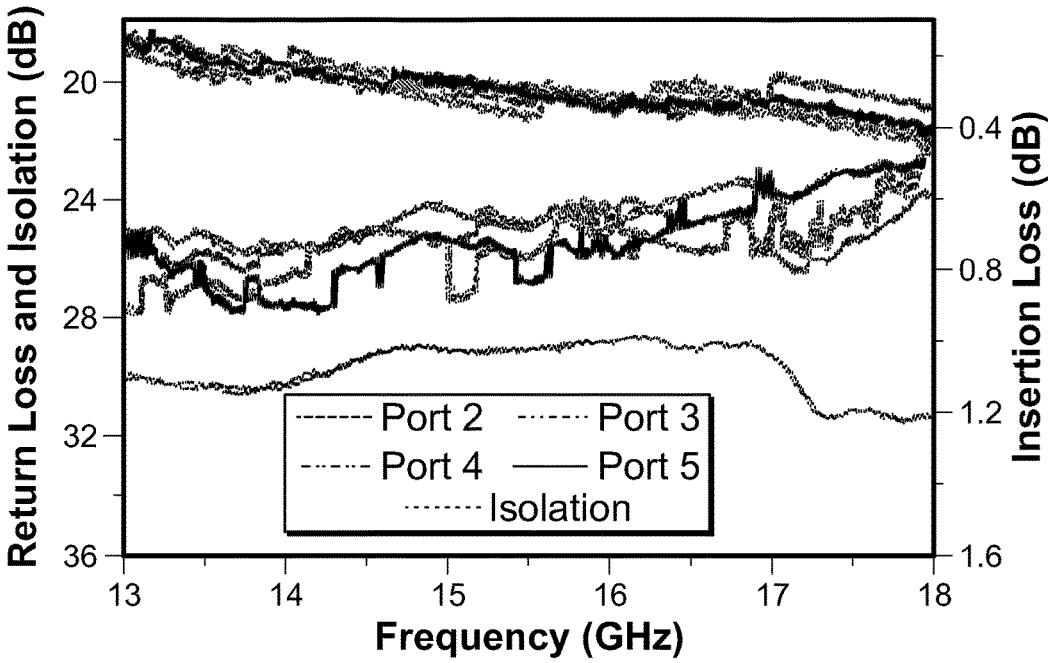
FIG. 4 is a graphical representation of loss performance for the switch of FIG. 2.

FIG. 4 shows a loss performance (measured in dB) for the example SP4T switches when operating in the Ku frequency band (e.g., between about 13 GHz and about 18 GHz) of the radio frequency spectrum. As shown in FIG. 4, isolation of the input port (not labeled) and output ports (labeled Ports 2-5) remains between about 30 dB and about 32 dB within the Ku frequency band. Also as shown in FIG. 4, return loss of each of the ports is between about 24 dB and about 28 dB, and insertion loss of each of the ports is between about 0.2 dB and about 0.4 dB, within the Ku frequency band.

One challenge of forming the above described phase shifter in a coplanar waveguide is routing and modeling of all of the signal lines within the plane of the waveguide. As the number of bits handled by the phase shifter increases, or the size of the phase shifter decreases, or both, proper routing of the signal lines becomes increasingly important for proper phase shifter performance (e.g., each channel phase shifting the transmitted signal the desired amount). In order to ensure proper performance of the channels, the effect of coupling between various pairs of channels can be performed.

Figure 5:
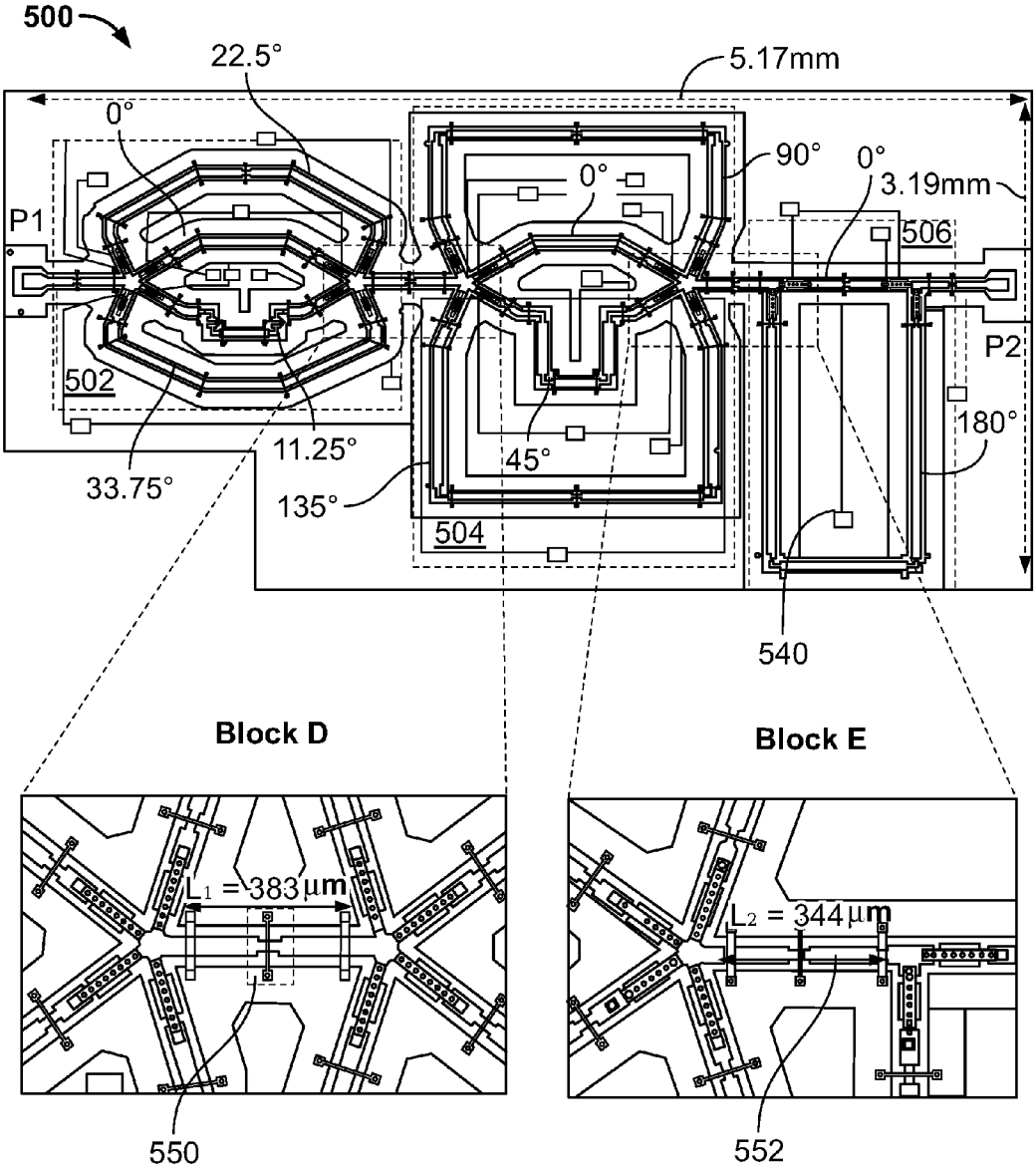
FIG. 5 is a plan view diagram showing an example phase shifter in accordance with another aspect of the present disclosure.

FIG. 5 is a plan view of an example phase shifter 500 in accordance with an aspect of the disclosure, including (from left to right) a fine 2-bit section 502, a coarse 2-bit section 504 and 1-bit section 506. In the fine 2-bit section, the phase delays of the respective channels are (from top to bottom) 22.5, 0, 11.25 and 33.75 degrees. In the coarse 2-bit section, the phase delays of the respective channels are (from top to bottom) 90, 0, 45 and 135 degrees. In the 1-bit section, the phase delays of the respective channels are (from top to bottom) 0 and 180 degrees. For each 2-bit and 1-bit section, the differences in phase velocity for each of the lines between the switches of that section produce the phase shifts over the operating band of the phase shifter 500.

FIG. 5 shows one example layout of channels between input port P1 and output port P2 for which the phase shifter was found to have good performance. It should be noted that in this example, the geometries of the 0 degree shift transmission lines of the 2-bit section are about the same, whereas the geometry of the 0 degree shift transmission line of the 1-bit section has a different geometry. The geometry of the phase shift transmission lines may be selected with the overall dimensions of the phase shifter in mind, and in turn the overall size of the device. In this regard, other geometries may be implemented in different examples, without deviating from the underlying advantages of the example of FIG. 5, so long as for each given section, the transmission lines of that section yield the desired phase shift relative to one another (regardless of phase of the incoming signal).

Also shown in FIG. 5 are the bias lines 540 of the phase shifter. The bias lines may be designed to be highly resistive, for instance including a layer of titanium tungsten, and may connect to the switched line in order to actuate the switches. In order to prevent shorting, the bias lines and transmission lines may be separated by a dielectric component, such as a layer of silicon dioxide.

As shown in FIG. 5, the overall size of the phase shifter is about 5.17 mm by about 3.19 mm. Also in FIG. 5, each section of the phase shifter is shown in greater detail (in Blocks D and E) to be cascaded by an inductive line 550, 552 (or "inductive section"). The length, geometry, and inductive properties of these lines are chosen to optimize matching between the sections of the phase shifter connected thereby. In the example of FIG. 5, the inductive section between the two 2-bit sections has a first length $L_1$ equal to about 383 microns long, and the inductive section between the coarse 2-bit section and the 1-bit section has a second length L2 equal to about 344 microns long. Improving inductive matching reduces parasitic inductive effects between the central junction and the throws of each switch. Also, in addition to improving inductive matching, the selected lengths can also remove unwanted off-path resonance. Use of a full wave simulation of the phase shifter design may further be used to identify areas that exhibit the best coupling between the connected sections ("high coupling areas"). In a similar vein, it is noted that inductive matching may also be improved at the input line by designing the central junctions of the sections to have a specific junction capacitance $C_j$. Junction capacitance may be optimized also through use of a full wave simulation of the phase shifter design.

In one example, for a phase shifter expected to operate in the Ku band, between about 13 GHz and 18 GHz, a full wave simulation from about 8 GHz through about 18 GHz may be run in order to identify any potential drops in insertion-loss response. The reason for running the simulation at frequencies below 13 GHz is that even if the drop in insertion-loss response is outside of the band of operation, after fabrication, and after the sections have been cascaded with one another, added parasitic and line capacitances can shift the performance drop towards the band of operation. The signal line length connecting the sections can be selected to overcome the off-path resonance from the different sections, and to ensure performance of the phase shifter with good phase accuracy.

Additionally, the geometry of the two inductive sections may be different. The inductive section 550 between the two 2-bit sections 502 and 504 includes notches or groves on both sides at the midpoint between the two connected sections. By contrast, the inductive section 552 between the coarse 2-bit section 504 and the 1-bit section 506 may include notches or grooves on both sides, or on only one side, at the midpoint between the two connected sections.

The junction capacitance, spoke length, inductive bends (e.g., at discontinuities of the CPW) may also help to reduce or eliminate higher order modes.

Figure 6:
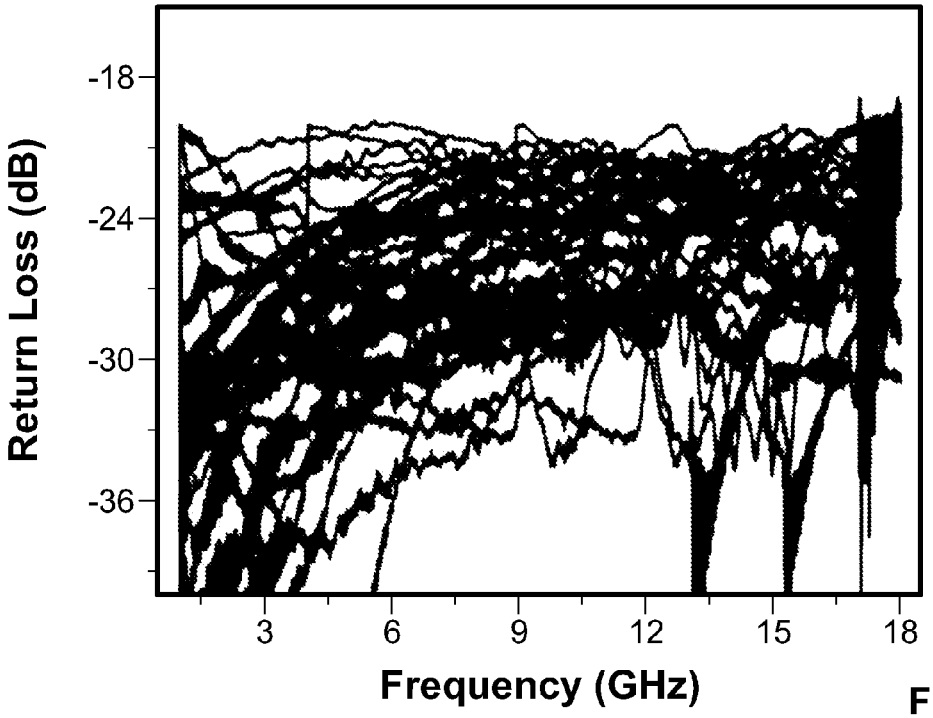
FIG. 6 is a graphical representation of return loss for the switch of FIG. 5.
Figure 7:
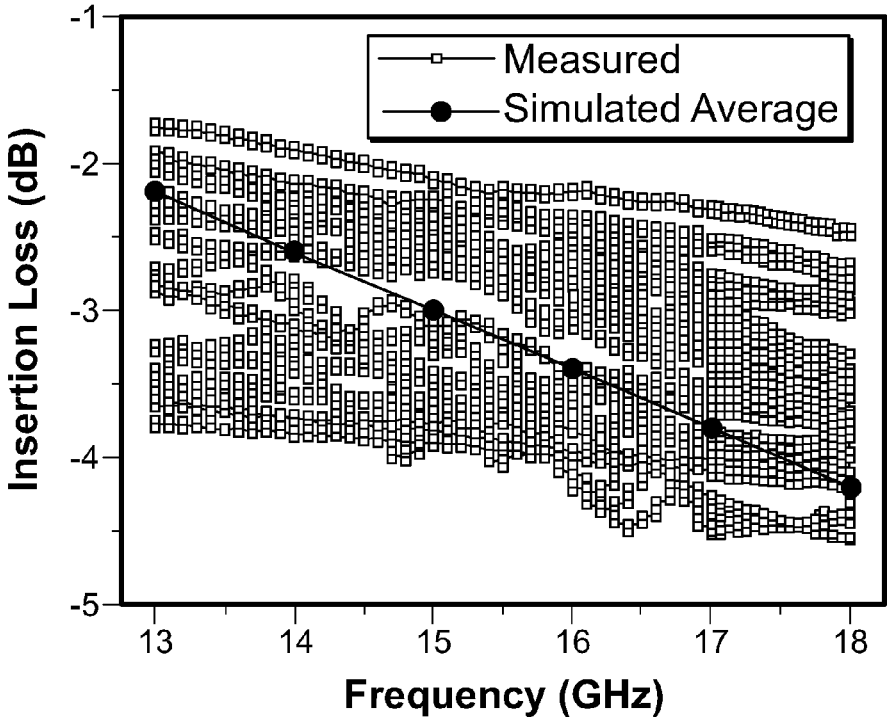
FIG. 7 is a graphical representation of insertion loss for the switch of FIG. 5.

FIGS. 6 and 7 are graphical representations of return loss and insertion loss (measured in dB), respectively, of the example 5-bit phase shifter of FIG. 5 across a range of frequencies (measured in GHz). As shown in FIG. 6, matching (both $S_{11}$ and $S_{22}$) for the phase shifter was found to be better than 19 dB over a frequency band of about 0.1 GHz to about 18 GHz. As shown in FIG. 7, based on a simulated average of several measurements of insertion loss across a frequency band of about 13 GHz to about 18 GHz, average insertion loss of the phase shifter was found to be as little as about 2.2 dB at about 13 GHz to as much as about 3.89 dB at about 18 GHz.

Figure 8:
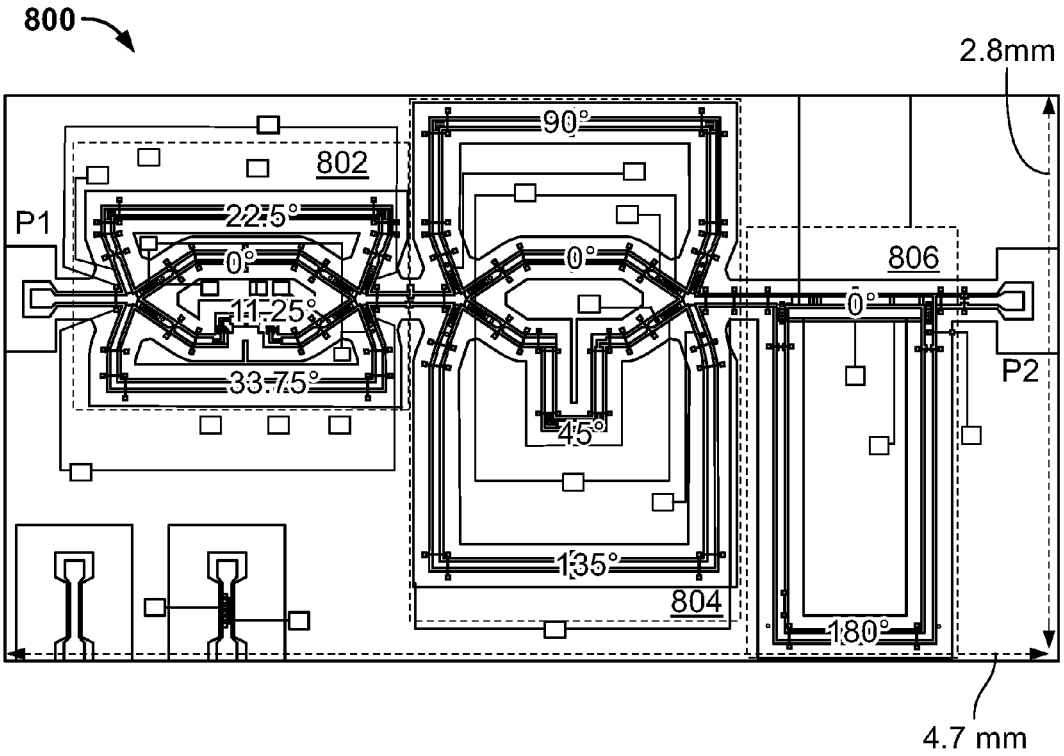
FIG. 8 is a plan view diagram showing another example phase shifter in accordance with the present disclosure.

FIG. 8 shows another example phase shifter 800 having similar properties to the phase shifter 500 that of FIG. 5 (e g, channels having similar respective phase delays, as described in connection with FIG. 5). The phase shifter 800 of FIG. 8 also includes a fine 2-bit section 802, a coarse 2-bit section 804, and a 1-bit section 806, between input port P1 and output port P2, and the phase delay channels of FIG. 8 are comparable to those of FIG. 5. A key difference between the two phase shifters is their overall size: the phase shifter of FIG. 8 is only about 4.7 mm by about 2.8 mm Thus, the phase shifter of FIG. 8 is about 24% more compact than the phase shifter of FIG. 5.

Figure 9:
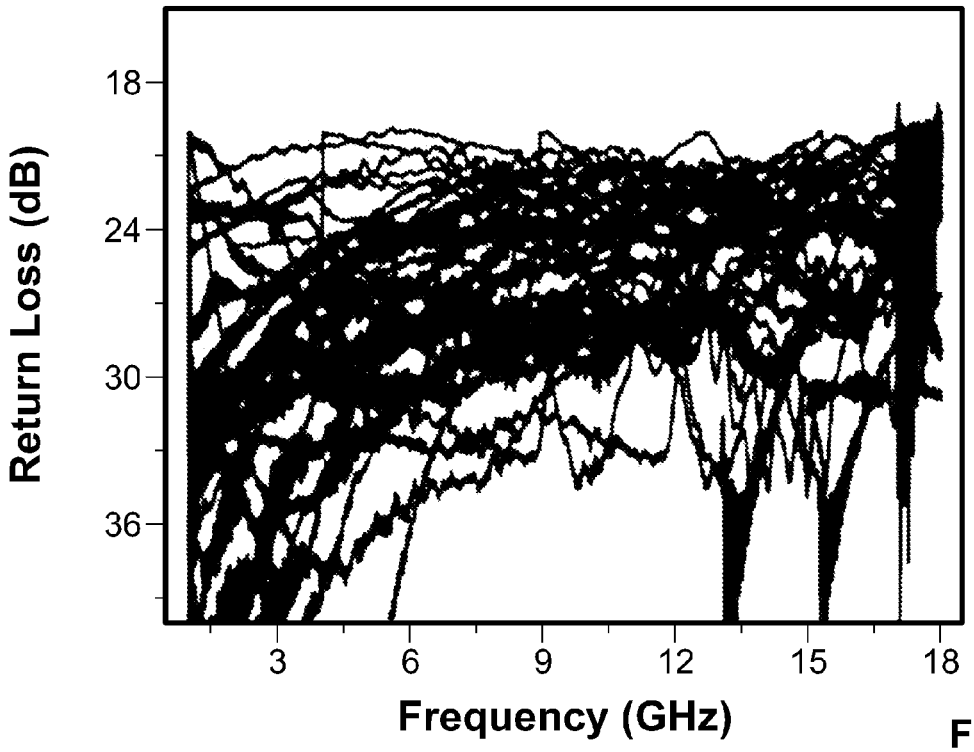
FIG. 9 is a graphical representation of return loss for the switch of FIG. 8.
Figure 10:
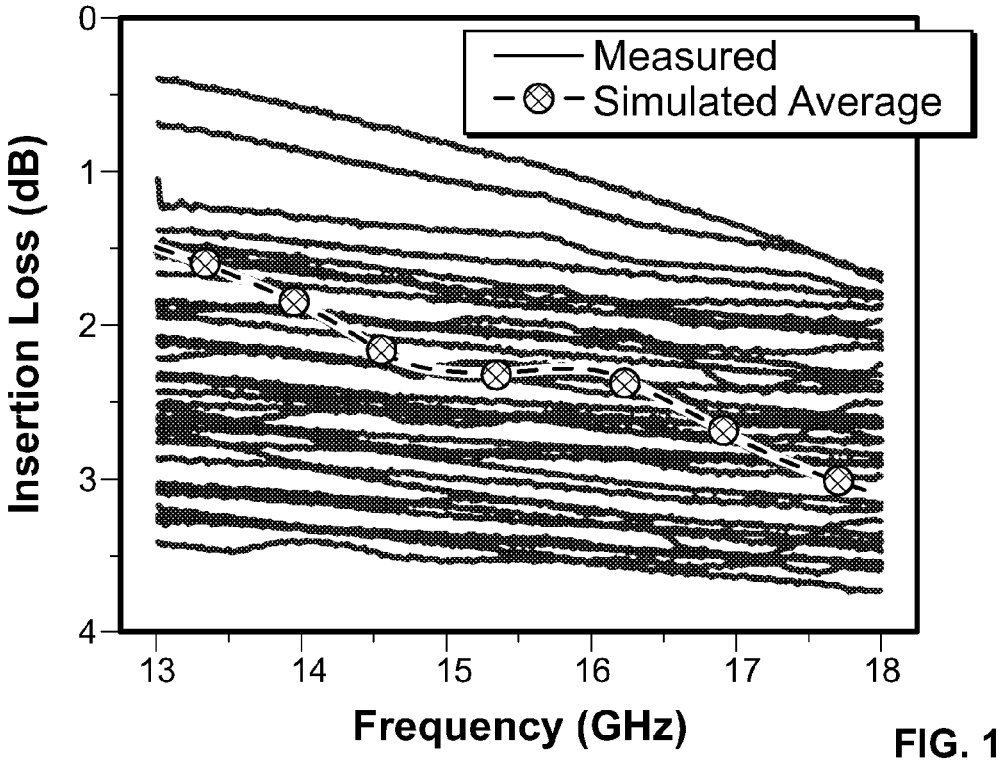
FIG. 10 is a graphical representation of insertion loss for the switch of FIG. 8.

FIGS. 9 and 10 are graphical representations of return loss and insertion loss (measured in dB), respectively, of the example 5-bit phase shifter of FIG. 8 across a range of frequencies (measured in GHz). As shown in FIG. 9, matching (both $S_{11}$ and $S_{22}$) for the phase shifter was found to be better than 22 dB over a frequency band of about 0.1 GHz to about 18 GHz. As shown in FIG. 10, based on a simulated average of several measurements of insertion loss across a frequency band of about 13 GHz to about 18 GHz, average insertion loss of the phase shifter was found to be as little as about 1.5 dB at about 13 GHz to as much as about 2.65 dB at about 18 GHz.

During fabrication of the example phase shifters of FIGS. 5 and 8, care should be taken not to introduce any contamination which may cause static friction to the cantilever switches. Therefore, it is preferable to ascertain that all switches may be released (e.g., a state of the switches may be changed) after fabrication is complete.

The above described structures, processes and considerations may be applied to yield a MEMS-based phase shifter having four SP4T switch circuits and two SPDT switch circuits on a CPW line. Although benefits of the phase shifter in contemporary applications are primarily obtained when the phase shifter is operated over a frequency band in the range of about 17 GHz of (e.g., about 16.75 to about 17.25 GHz), such a phase shifter may be capable of performance across any portion of the Ku band, including the entire Ku band. In particular, the present disclosure makes it possible to achieve 0-360° phase shift with an 11.25° between each step in phase (i.e., 5-bit output) using a device having an area of about 15 $mm^2$ or less. Such a phase shifter may include a total of 20 DC-contact switches and connecting CPW transmission lines, and may have good reliability of performance at microwave frequencies over a frequency band of about 500 MHz.

The above example phase shifters have also been found to exhibit, during a stress relaxation process, about 1.36 dB of loss variation from their initial value (particularly between about 3.55 dB and about 4.91 dB) and an overall maximum variation in phase error of about 1.24° (particularly between about 0.87° about 2.11°) when operating at an operating frequency of 17 GHz at a temperature of 25° C. and with a 70 volt bias. The example phase shifters have also been found to operate under 2 W cold switched conditions for up to one million cycles.

Figure 11:
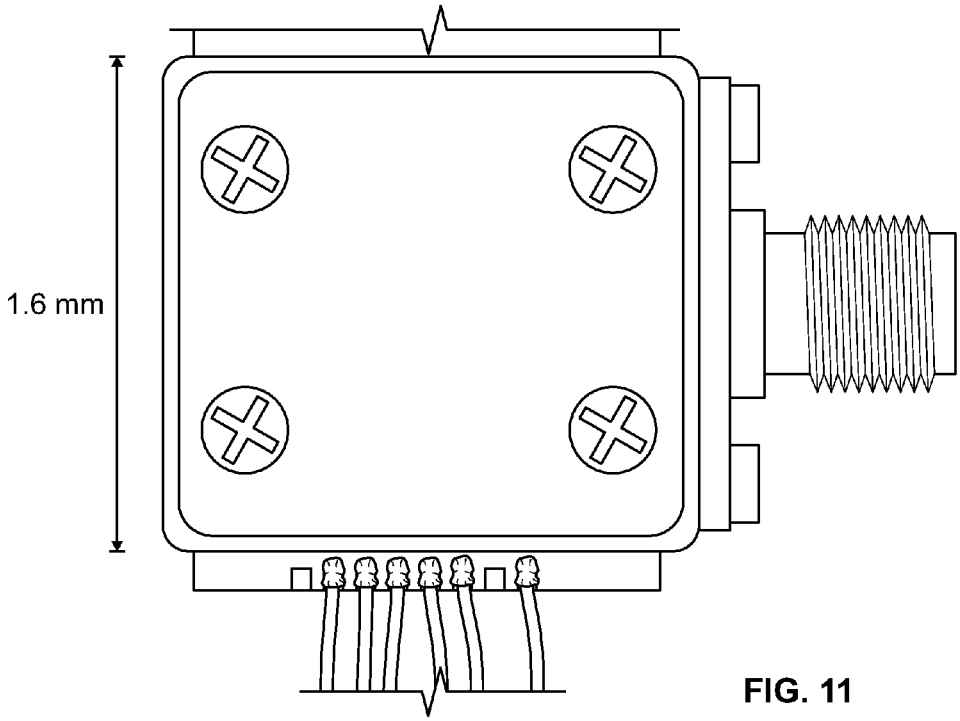
FIG. 11 is a perspective view showing an example phase shifter, in accordance with the disclosure, mounted on a test jig.

FIG. 11 is a photograph of an example phase shifter designed in accordance with the above disclosure and mounted on a test jig. As shown in FIG. 11, the phase shifter has a width of approximately 1.6 mm.

Figure 12:
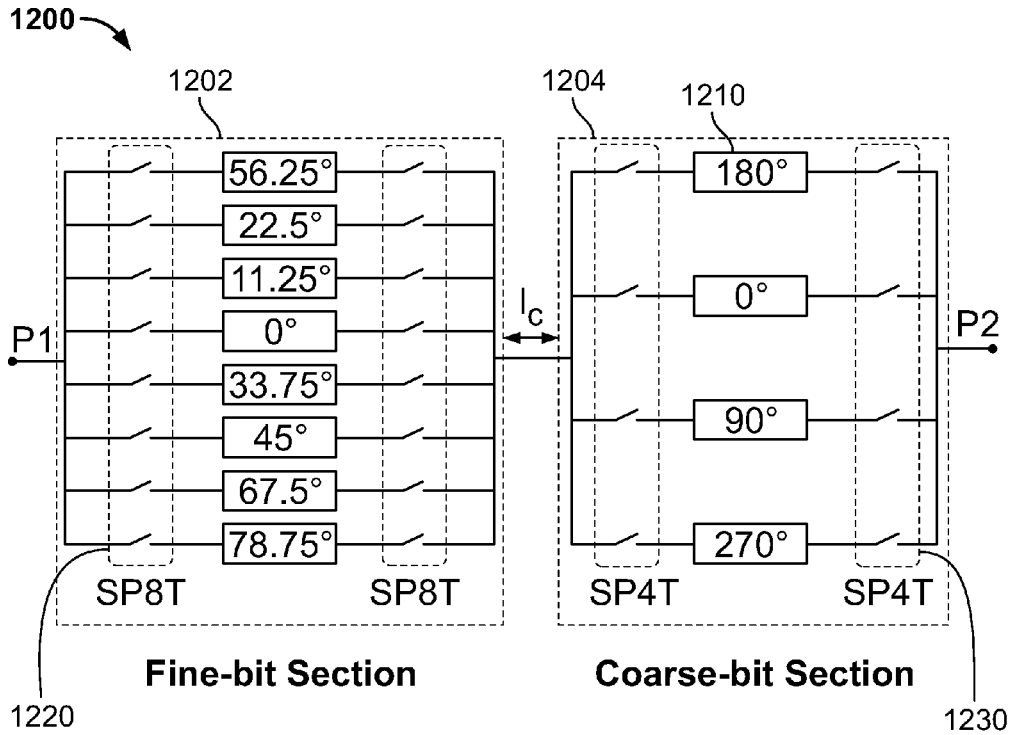
FIG. 12 is a schematic diagram showing another example phase shifter in accordance with the present disclosure.

FIG. 12 shows another 5-bit phase shifter 1200 utilizing a 3-bit section 1202 cascaded in series with a 2-bit section 1204 between an input port P1 and output port P2. Relatively speaking, in the 5-bit phase shifter 1200 of FIG. 12, the 3-bit section serves as a fine bit section, and the 2-bit section serves as a coarse bit section. The 3-bit section 1202 includes a pair of MEMS-based single pole eight throw (SP8T) switch circuits 1220, each of the eight switches in the first switch circuit connected to a corresponding switch in the second circuit by a transmission line 1210. The channels of the 3-bit section 1202 have phase delays of 0, 11.25, 22.5, 33.75, 45, 56.25, 67.5, and 78.75 degrees, respectively. The 2-bit section 1204 includes a pair of SP4T switch circuits 1230, each of the four switches in the first switch circuit connected to a corresponding switch in the second circuit also by a transmission line 1210. The channels of the 2-bit section 1204 have phase delays of 0, 90, 180 and 270 degrees, respectively. The two sections 1220, 1230 are connected by an inductive section having a length $l_C$. This design requires only four switches to be actuated at a time to activate one phase state and it leads to a uniform actuation over the cycle.

Figure 13:
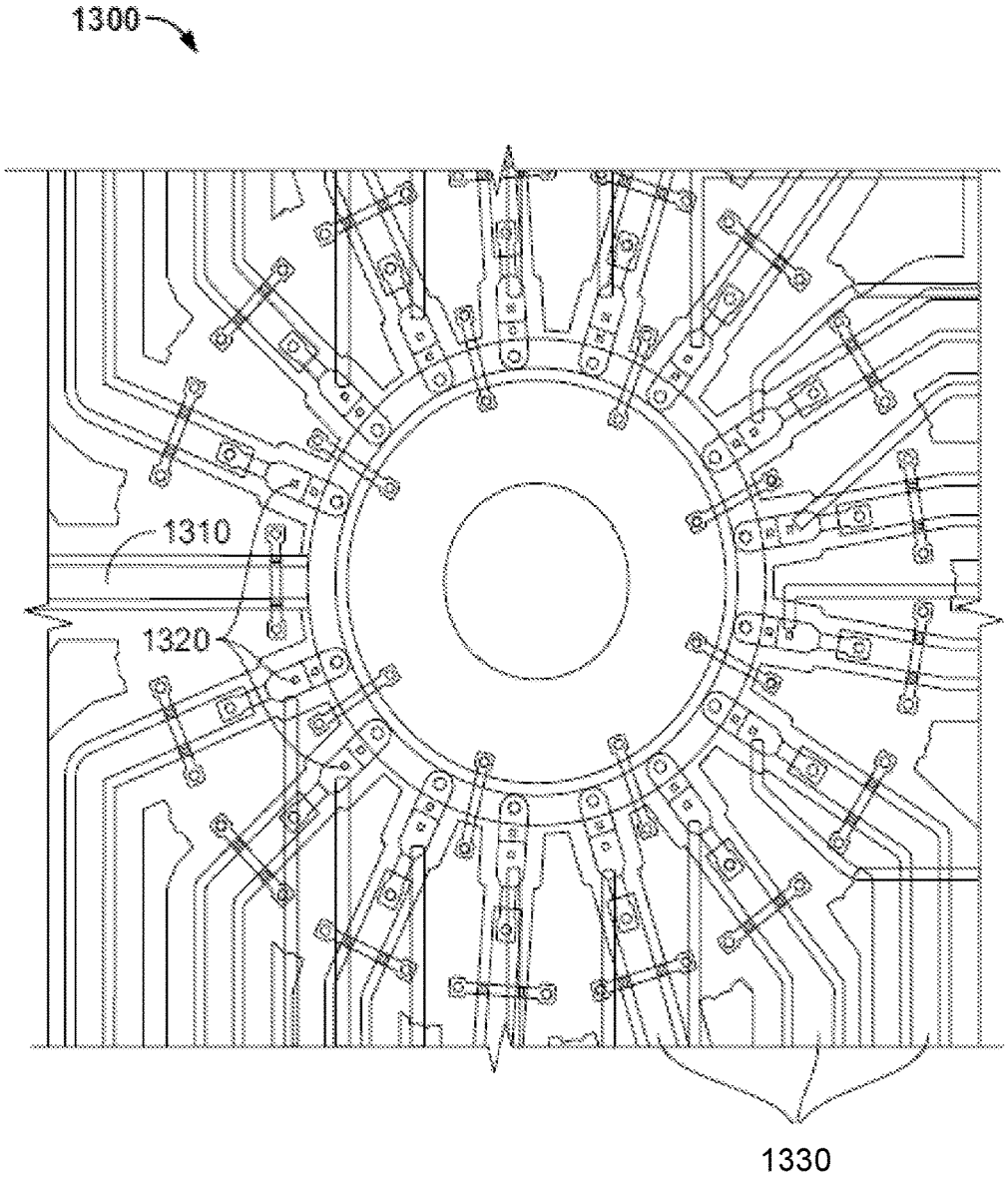
FIG. 13 is a plan view diagram showing an example single-pole sixteen-throw (SP16T) switch in accordance with the present disclosure.

The present disclosure also provides for a 4-bit phase shifter that achieves low loss, low power consumption, and good phase accuracy within a compact size, even at frequencies within the Ku band. The 4-bit phase shifter utilizes a pair of MEMS-based single pole sixteen throw (SPMT) switch circuits. FIG. 13 shows an example RF MEMS single-pole sixteen-throw (SP16T) switch circuit 1300. The switch circuit 1300 includes a plurality of cantilever beams 1320 positioned between in a circular type CPW line configuration. The CPW line is also connected to an input port 1310. The input port 1310 is connected to sixteen second ports 1330 by the sixteen respective cantilever beams 1320. The input and output ports, of which there are seventeen in total, are evenly distributed in a circular pattern. The angle between adjacent ports is thus about 21.17°.

The cantilever beams 1320 of FIG. 13 move in and out of the plane of the CPW line, thereby electrically connecting and disconnecting one port to a contact bump of the opposing port. Each cantilever beam is further attached to three mechanical springs arranged relative to one another in a Y-configuration. Like the cantilever beams, the mechanical springs move in and out of the plane of FIG. 13 (in the z-direction of the switch ports). The total area of the SP16T switch circuit 1300 is about 2.5 $mm^2$ (about 1.56 mm across, and about 1.61 mm top to bottom).

Figure 14:
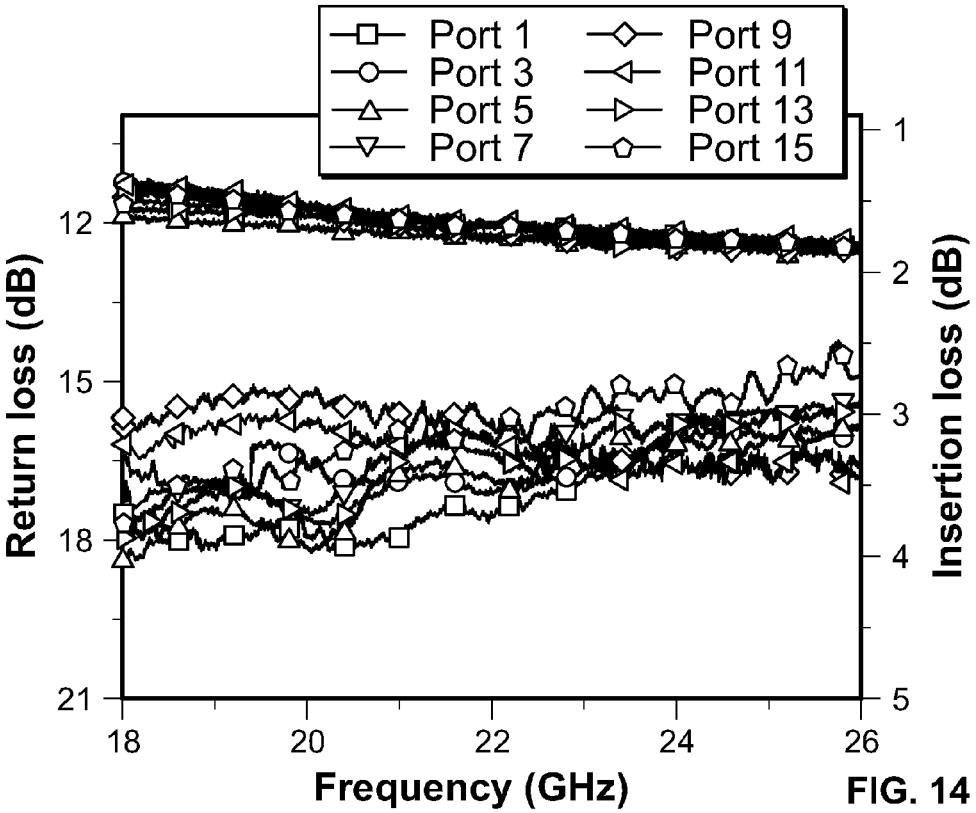
FIG. 14 is a graphical representation of return loss and insertion loss for the switch of FIG. 13.
Figure 15:
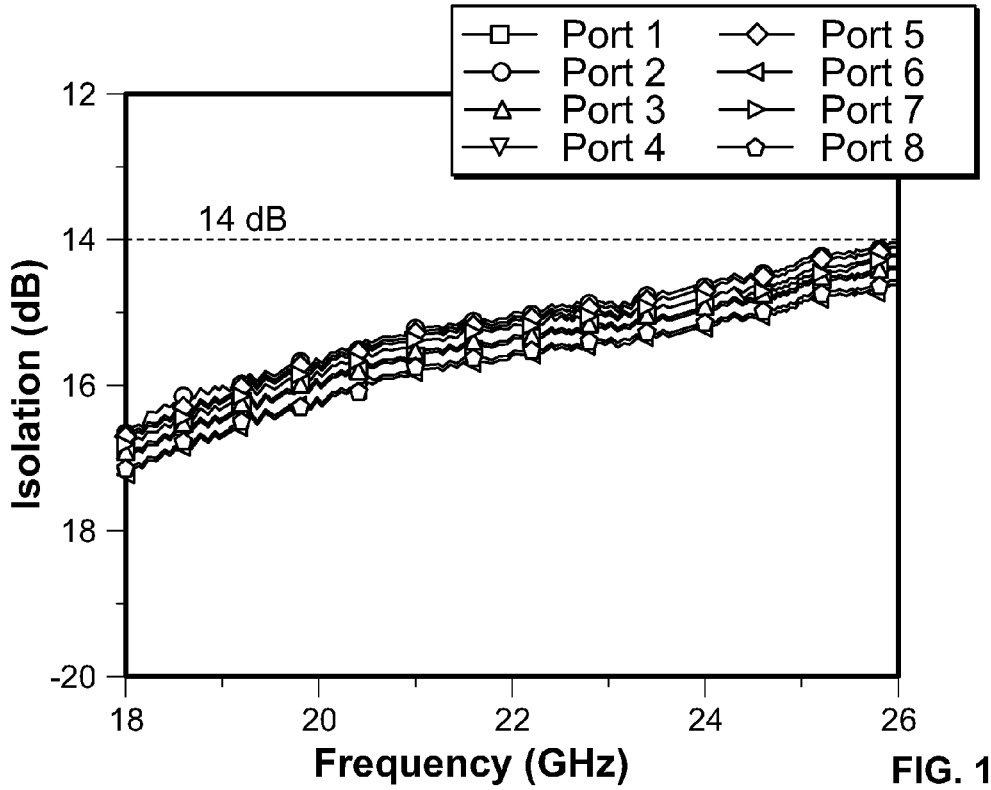
FIG. 15 is a graphical representation of isolation for the switch of FIG. 13.

FIGS. 14 and 15 show simulated return loss, isolation, and insertion loss (measured in dB) for the example SP16T switch circuit design of FIG. 13 across a range of frequencies (measured in GHz). As shown in FIG. 14, each of ports 1, 3, 5, 7, 9, 11, 13 and 15 of the SP16T switch circuit exhibits return loss of better than about 14 dB (in particular, between about 14 dB and about 18 dB) and worst case insertion loss of about 1.9 dB (in particular, between about 1.4 dB and about 1.8 dB) across a range of frequencies between about 18 GHz and about 26 GHz. FIG. 15 shows that each of ports 1, 2, 3, 4, 5, 6, 7 and 8 of the SP16T switch circuit exhibits isolation of about 14 dB up (in particular, between about 14 dB and 17 dB) across the same range of frequencies between about 18 GHz and about 26 GHz.

The SP16T switch circuit is described in greater detail in the '289 application.

Two SP16T switch circuits (also referred to as switching networks) may be connected to produce a K-band 4-bit phase shifter. Each of the 16 ports (and thus cantilever beam or switch) of the first SP16T switch circuit may be connected to a corresponding port (and thus corresponding cantilever beam or switch) of the other SP16T switch circuit. Each of the signal lines connecting the corresponding ports to one another may provide a different phase delay. The SP16T switch circuits and signal lines are all formed on a common surface of a substrate. More specifically, the SP16T switch circuits and signals lines are formed in a CPW, whereby the ground plane is formed on the same surface of the substrate.

Figure 16:
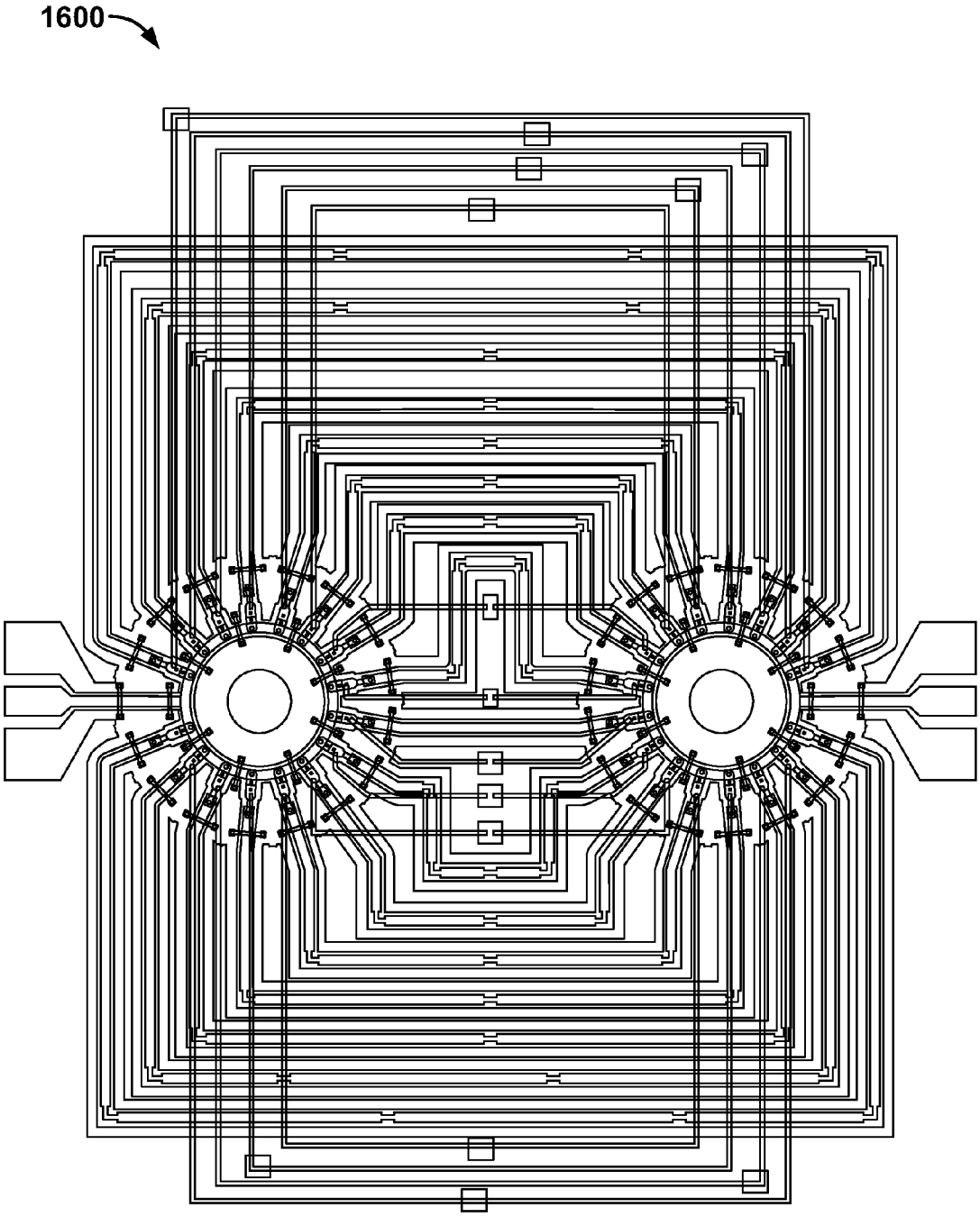
FIG. 16 is a plan view diagram showing an example 4-bit phase shifter in accordance with the present disclosure.

FIG. 16 shows an example of two SP16T switch circuits connected to one another in the above-described configuration. In FIG. 16, the phase delays of the respective connecting lines are, from top to bottom: 337.5°, 292.5°, 247.5°, 180°, 157.5°, 112.5°, 67.5°, 22.5°, 0°, 45°, 90°, 135°, 202.5°, 225°, 270°, and 315°. Thus, the two switches form a 4-bit phase shifter 1600 capable of delaying a signal at any one of sixteen different phases. The overall area of the phase shifter is about 3.62 mm across and about 4.2 mm top to bottom, or about 15.2 $mm^2$, including bias lines and bias pads.

Figure 17:
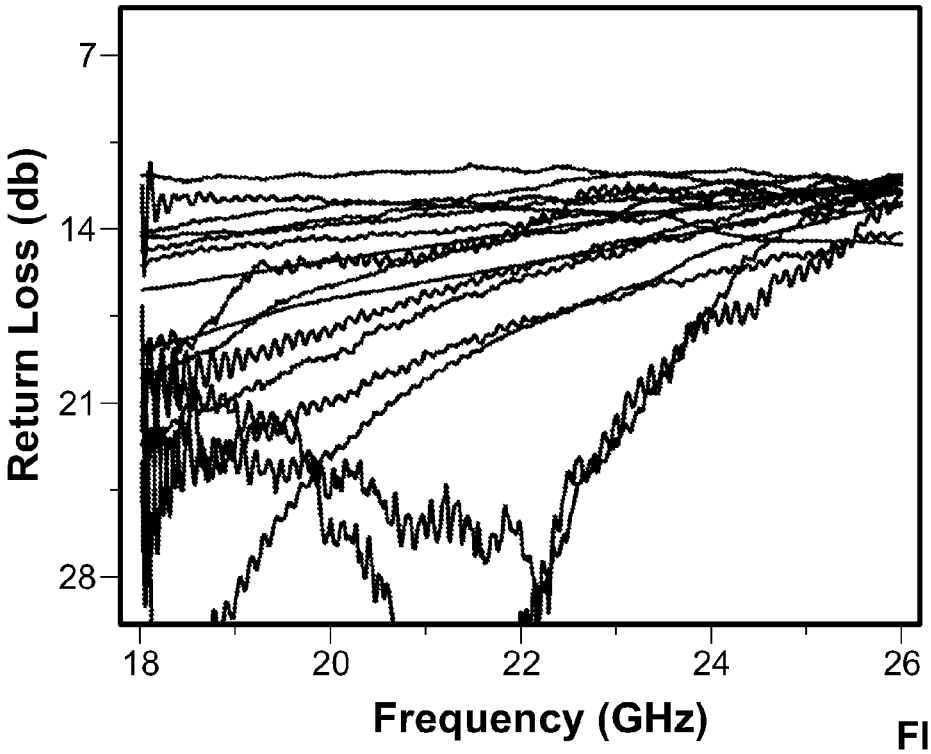
FIG. 17 is a graphical representation of return loss for the phase shifter of FIG. 16.
Figure 18:
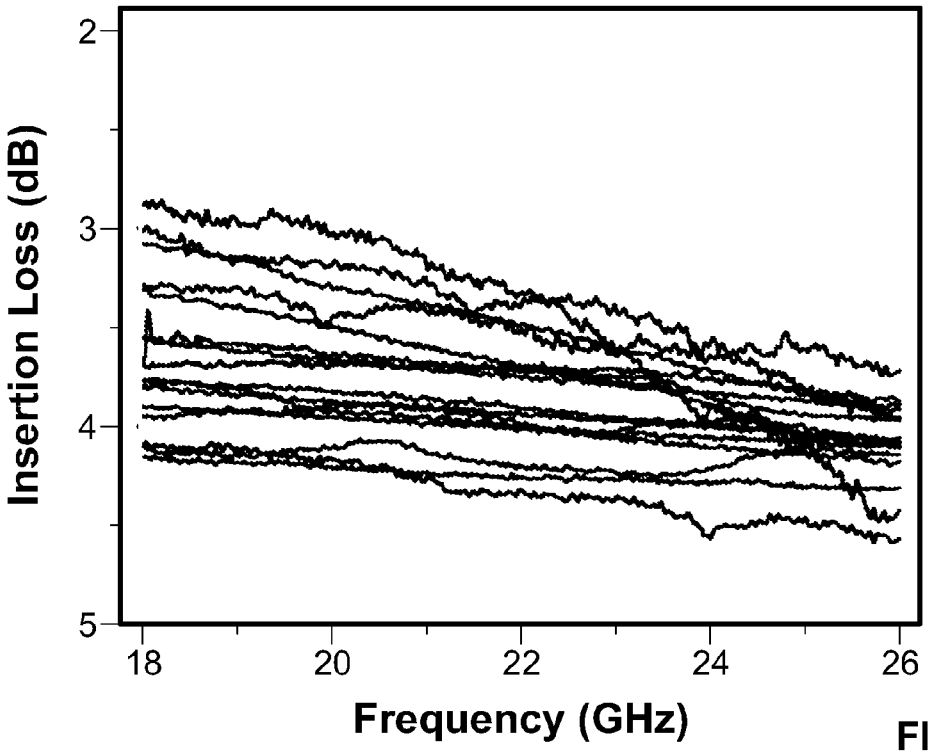
FIG. 18 is a graphical representation of insertion loss for the phase shifter of FIG. 16.

FIGS. 17 and 18 are graphical representations of return loss and insertion loss performances (measured in dB) of the 4-bit phase shifter using two SP16T switching networks across a range of frequencies (measured in GHz). As shown in FIG. 17, the return loss is measured to be better than about 10 dB for frequencies between about 18 GHz and about 26 GHz. As shown in FIG. 18, worst case insertion loss is measured to be about 4.58 dB across a similar range of frequencies.

Figure 19:
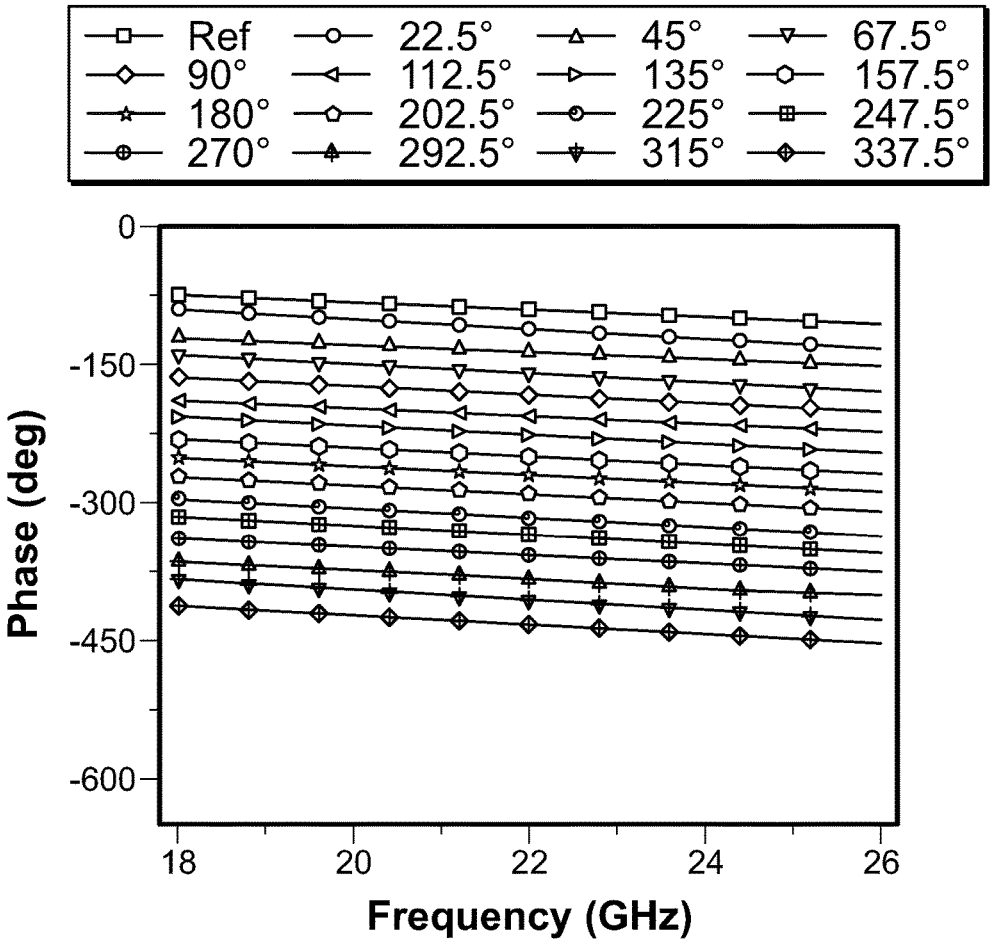
FIG. 19 is a graphical representation of phase error as a function of frequency response for the phase shifter of FIG. 16.

FIG. 19 is a graphical representation of the phase shifter's phase (measured in degrees) across a range of frequencies (measured in GHz). The measurements shown in FIG. 19 were taken for each of the phase shifter channels, having respective phase shifts of 0° (Ref), 22.5°, 45°, 67.5°, 90°, 112.5°, 135°, 157.5°, 180°, 202.5°, 225°, 247.5°, 270°, 292.5°, 315°, and 337.5°. As shown in FIG. 19, the measured average phase error of the phase shifter is about 2.3° at a frequency of about 25 GHz.

Notably, the 4-bit SP16T-based switching network is reliable while maintaining a relatively simple topology. The switching network requires only two switches to be actuated at a given time in order to activate a given phase state. Thus, the switching network can significantly improve the reliability of a device into which it is incorporated.

The number of switch actuations for a given switch or device, is an important factor in the reliability of the switch or device. In the case of a single switch, a "switch cycle" constitutes one cycle of actuations between two states of operation: ON and OFF. However, in the case of the 5-bit phase shifter described above, a "switch cycle" constitutes 32 states of operation, over which cycle each of the 2-bit fine and coarse sections are actuated 8 times per cycle, and the 1-bit section is actuated 16 times per cycle. Since the 1-bit section must be actuated more times in a given cycle than the 2-bit section, it may be recognized that the probability of failure for the 1-bit section may be greater than for either of the 2-bit sections. Furthermore, the 5-bit phase shifter is subject to non-uniform switch actuation, since the 1-bit section is actuated more frequently than either 2-bit section.

By comparison, the SP16T-based 4-bit phase shifter includes only one 4-bit section. Therefore, it does not carry the probability of failure associated with the 1-bit section, and all does not have the non-uniform switch actuation property of the 5-bit phase shifter, thereby making it a more reliable device. Thus, the SP16T-based topology could be used for higher-bit configurations in order to improve the reliability and performance of the phase shifter.

Notably, the 5-bit phase shifter utilizing a pair of SP8T switch circuits cascaded with a pair of SP4T switch circuits would also provide some improvement in reliability, although there would still be non-uniform switch actuation, since the SP4T switch circuits would actuate twice as frequently as the SP8T switch circuits.

Example applications for the phase shifters described herein may include space-based radar systems, which often use passive electronically scanned arrays (ESAs), as well as modern communication systems and high precision instrumentation systems. Approximately hundreds of thousands of radiating elements are used in ESAs. For each radiating element, there is a phase shifter (often 3 to 5 bits) that collectively controls the direction of the antenna beam and its side-lobe properties. For ESAs using hundreds of thousands of phase shifters, the methods and devices of the present disclosure may provide a relatively low cost, relatively light weight (including package and installation) solution, while exhibiting relatively low RF losses.

In synthetic aperture radar (SAR) applications, a 17 GHz frequency is commonly utilized, making the phase shifters of the present disclosure especially beneficial for such applications. In such applications, the module size of the phase shifter could allow for 4 T/R modules to feed a 16×16-element sub-array on an antenna panel.

Additionally, the example phase shifters of the present disclosure include SPDT, SP4T, SP8T and SP16T switch circuits. However, in other examples, other types of SPMT switch circuits may be utilized. For example, a single pole three throw (SP3T) switch circuit may be utilized. For example, four cascaded SP3T switch circuits may yield a 3-bit output.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

The invention claimed is:

1. A phase shifter comprising at least a first phase shift section, the first phase shift section comprising:

a first input port for receiving an incoming radio frequency signal;

a first output port for transmitting an outgoing radio frequency signal;

a first input junction coupled to the first input port, the first input junction including a first plurality of switches;

a first output junction coupled to the first output port, the first output junction including a second plurality of switches; and a first plurality of transmission lines, wherein each transmission line of the first plurality of transmission lines connects a respective one of the first plurality of switches to a corresponding one of the second plurality of switches, wherein the first plurality of switches, the second plurality of switches, and the first plurality of transmission lines are formed in a coplanar waveguide, wherein each switch of the first and second pluralities of switches includes a respective cantilever beam having a fixed end and a free end connected to opposing switch ports of the corresponding switch, and a respective mechanical spring connected to the corresponding cantilever beam, the respective mechanical spring providing a mechanical force to move the free end of the corresponding cantilever beam into and out of contact with one of the switch ports, and wherein each corresponding mechanical spring is actuated by a separate actuator.

2. A phase shifter according to claim 1, wherein the first plurality of switches includes at least four cantilever type switches, and the second plurality of switches includes at least four cantilever type switches.

3. A phase shifter according to claim 1, wherein the first plurality of switches includes at least eight cantilever type switches, and the second plurality of switches includes at least eight cantilever type switches.

4. A phase shifter according to claim 1, wherein the first plurality of switches includes sixteen cantilever type switches, and the second plurality of switches includes sixteen cantilever type switches.

5. A phase shifter according to claim 1, wherein the first phase shift section is a 2-bit phase shift section including first and second single pole four throw (SP4T) microelectromechanical switch circuits, and wherein the phase shifter further comprises a 3-bit phase shift section including first and second single pole eight throw (SP8T) microelectromechanical switch circuits.

6. A phase shifter according to claim 5, wherein only four switches of the phase shifter are actuated at a given time to produce a 5-bit output.

7. A phase array comprising a plurality of phase shifters according to claim 1.

8. A phase array according to claim 7, wherein the phase array is a passive electronically scanned array and comprises a plurality of radiating elements, each radiating element having a corresponding one of the plurality of phase shifters.

9. A phase shifter according to claim 1, wherein the phase shifter is capable of producing a 5-bit output with fewer than ten switches actuated at a given time.

10. A phase shifter according to claim 1, wherein the phase shifter is operable in the Ku frequency band with a bandwidth of about 500 MHz.

11. A phase shifter, comprising:

a substrate having a ground element formed on a side of the substrate;

a first 2-bit phase shift section including first and second single pole four throw (SP4T) microelectromechanical switch circuits, wherein the first and second SP4T switch circuits are formed on the substrate on the same side as the ground element, a second 2-bit phase shift section including third and fourth SP4T microelectromechanical switch circuits, wherein the third and fourth SP4T switch circuits are formed on the substrate on the same side as the ground element; and a third 1-bit phase shift section including first and second single pole double throw (SPDT) microelectromechanical switch circuits, wherein the first and second SPDT switch circuits are formed on the substrate on the same side as the ground element, and wherein the first 2-bit section, second 2-bit section, and third 1-bit section are serially connected to one another.

12. A phase shifter according to claim 11, wherein the phase shifter occupies an area of about 5.17 mm by about 3.19 mm.

13. A phase shifter according to claim 11, wherein the phase shifter occupies an area of about 4.7 mm by about 2.8 mm.

14. A phase shifter according to claim 11, wherein each of the SP4T and SPDT microelectromechanical switch circuits is a single-contact switch about 2 microns thick.

15. A phase shifter according to claim 11, wherein only six switches of the phase shifter are actuated at a given time to produce a 5-bit output.

16. A phase shifter according to claim 11, wherein said first, second and third phase shift sections are cascaded on a coplanar waveguide line.

17. A phase shifter, comprising:

a substrate;

a first single pole sixteen throw (SP16T) microelectromechanical switch circuit;

a second single pole sixteen throw (SP16T) microelectromechanical switch circuit;

sixteen signal lines, each signal line connecting respective switches of the first and second SP16T switch circuits to one another;

wherein the first and second SP16T switch circuits and sixteen signal lines occupy an area of about 15.2 $mm^2$ on a surface of the substrate.

18. A phase shifter according to claim 17, wherein only one switch of the first SP16T microelectromechanical switch circuit and one switch of the second SP16T microelectromechanical switch circuit are actuated at a given time to produce a 4-bit output, and wherein the phase shifter exhibits uniform switch actuation.

19. A phase shifter according to claim 1, wherein the phase shifter further comprises a second phase shift section comprising:

a second input port;

a second output port;

a second input junction coupled to the second input port, the second input junction including a third plurality of switches;

a second output junction coupled to the second output port, the second output junction including a fourth plurality of switches; and a second plurality of transmission lines, wherein each transmission line connects one of the third plurality of switches to a corresponding one of the fourth plurality of switches, wherein the third plurality of switches, the fourth plurality of switches, and the second plurality of transmission lines are formed in the coplanar waveguide, and wherein each respective switch of the third and fourth pluralities of switches includes a respective cantilever beam having a fixed end and a free end connected to opposing switch ports of the corresponding switch, and a respective mechanical spring connected to the corresponding cantilever beam, the respective mechanical spring providing a mechanical force to move the free end of the corresponding cantilever beam into and out of contact with one of the switch ports, and wherein each corresponding mechanical spring is actuated by a separate actuator, and wherein the first output junction is coupled to the second input junction by a transmission line formed in the coplanar waveguide.

20. A phase shifter according to claim 19, wherein the transmission line connecting the first output junction to the second input junction further includes an inductive section for matching inductances of the phase shift sections.

21. A phase shifter according to claim 19, wherein each of the first input junction and the second input junction includes at least four cantilever type switches, and wherein each of the first output junction and the second output junction includes at least four cantilever type switches.

22. A phase shifter according to claim 21, further comprising a third phase shift section, comprising:

a third input port;

a third output port;

a third input junction coupled to the third input port, the third input junction including a fifth plurality of cantilever type switches; and a third output junction coupled to the third output port, the third output junction including a sixth plurality of cantilever type switches.

* * * * *